US005537082A

United States Patent [19]

Tada et al.

[11] Patent Number: 5,537,082

[45] Date of Patent: Jul. 16, 1996

[54] DIELECTRIC RESONATOR APPARATUS INCLUDING MEANS FOR ADJUSTING THE DEGREE OF COUPLING

[75] Inventors: Hitoshi Tada, Ishikawa-ken; Hideyuki Kato; Tatsuya Tsujiguchi, both of Kanazawa; Yukihiro Kitaichi, Ishikawa-ken; Tadahiro Yorita, Kanazawa; Hisashi Mori, Kanazawa; Haruo Matsumoto, Kanazawa, all of Japan

[73] Assignee: Murata Manufacturing Co., Ltd., Japan

[21] Appl. No.: 198,819

[22] Filed: Feb. 18, 1994

[30] Foreign Application Priority Data

Feb. 25, 1993 [JP] Japan ..... 5-062576

[51] Int. Cl.[6] ..... H01P 1/205

[52] U.S. Cl. ..... 333/202; 333/207

[58] Field of Search ..... 333/202, 206, 333/207, 203, 222, 223

[56] References Cited

U.S. PATENT DOCUMENTS

| | | | |
|---|---|---|---|
| 4,523,162 | 6/1985 | Johnson | 333/203 X |
| 4,733,208 | 3/1988 | Ishikawa et al. | 333/206 X |
| 5,208,565 | 5/1993 | Sogo et al. | 333/206 |

FOREIGN PATENT DOCUMENTS

| | | | |
|---|---|---|---|
| 0538894 | 4/1993 | European Pat. Off. | 333/202 |
| 165102 | 8/1985 | Japan | 333/202 |
| 040802 | 2/1987 | Japan | 333/202 |
| 183603 | 8/1987 | Japan | 333/206 |
| 0041301 | 2/1989 | Japan | 333/202 |
| 4-139901 | 5/1992 | Japan | 333/206 |
| 302502 | 10/1992 | Japan | 333/206 |
| 5-335806 | 12/1993 | Japan | 333/202 DB |
| 5-327318 | 12/1993 | Japan | 333/206 |
| 5-327312 | 12/1993 | Japan | 333/206 |

*Primary Examiner*—Benny Lee

*Attorney, Agent, or Firm*—Majestic, Parsons, Siebert & Hsue

[57] ABSTRACT

A compact dielectric resonator apparatus is comprised of a dielectric block having a plurality of mutually parallel throughholes formed therethrough with inner surfaces covered with a conductive film so as to provide coaxial resonators. The degree of coupling between a mutually adjacent pair of such dielectric resonators can be adjusted by forming grooves, a bottomed hole or a slit or burying a conductive plate therebetween in the dielectric block, and varying physical characteristics of such grooves, bottomed hole, slit and/or conductive plate, without changing the separations between the throughholes or the external dimensions of the dielectric block.

15 Claims, 17 Drawing Sheets

DIELECTRIC RESONATOR APPARATUS INCLUDING MEANS FOR ADJUSTING THE DEGREE OF COUPLING

BACKGROUND OF THE INVENTION

This invention relates to dielectric resonators and, more particularly, to a dielectric resonator apparatus having a plurality of dielectric coaxial resonators unistructurally formed inside a single dielectric block.

In electronic circuits containing resonance circuit sections such as high-frequency band filters (e.g., band pass filters and band rejection filters) or oscillators, it is common to make use of resonance parts using dielectric members (hereinafter referred to as dielectric resonator apparatus) in the resonance circuit section in order to achieve improvements in circuit characteristics and reduction in size. With prior art dielectric resonator apparatus, desired frequency characteristics were obtained by aligning a plurality of dielectric resonators inside a single case and connecting these dielectric resonators by means of external connector elements. Dielectric resonator apparatus thus structured are disadvantageous in that the number of components is large and that they tend to be heavy. For this reason, demands for smaller and lighter dielectric resonator apparatus have been growing. In applications to mobile communication systems such as portable telephones and car telephones, it is particularly important to provide smaller and lighter dielectric resonator apparatus.

The present applicant has earlier proposed a single-body type dielectric resonator apparatus which can be made smaller and lighter than prior art dielectric resonator apparatus (Japanese Patent Application 4-9207). As a background to the present invention, this dielectric resonator apparatus earlier considered but not published, will be described next in some detail with reference to FIGS. 17–22.

FIG. 17 is an external diagonal view of this earlier considered dielectric resonator apparatus when it is about to be completed, having a dielectric block 1 approximately in the shape of a parallelepiped with two throughholes 5*a* and 5*b* penetrating therethrough from one end surface 1*a* to the opposite end surface 1*b*. An outer conductor 4 is formed nearly all over the outer surfaces of the dielectric block 1, except there are two signal input and output electrodes 9*a* and 9*b* also formed on the outer surfaces of the dielectric block 1 but in an electrically insulated condition from the outer conductor 4. The outer conductor 4 is grounded when the dielectric resonator apparatus is mounted on a circuit board (not shown), and the signal input and output electrodes 9*a* and 9*b* are connected to signal input and output terminals on this circuit board. As shown in FIG. 18, which is a sectional view of the dielectric block 1 of FIG. 17 across a plane longitudinally cutting across either of the throughholes 5*a* or 5*b*, an inner conductor 3 is formed all over the inner surfaces of the throughholes 5*a* and 5*b*.

When the dielectric resonator apparatus is in the condition shown in FIGS. 17 and 18, a portion of the inner conductor 3 is removed from the interior of the throughholes 5*a* and 5*b* as shown in FIGS. 19 and 20. As shown more clearly in FIG. 19, the portion of the inner conductor 3 which is removed is that portion with a specified longitudinal length t from one end surface 1*a* of the block 1 inward, thereby leaving an uncovered part α inside each of the throughholes 5*a* and 5*b*. This means that the portion of the outer conductor 4 which is on the (first) end surface 1*a* is in an electrically "open" (or not contacting) relationship with the inner conductor 3 inside each of the throughholes 5*a* and 5*b*, while another portion of the outer conductor 4 on the other (or second) end surface 1*b* of the dielectric block 1 is electrically connected to the inner conductor 3 inside each of the throughholes 5*a* and 5*b*. For this reason, the first and second end surfaces 1*a* and 1*b* of the dielectric block 1 may be referred to as the open end surface and the short-circuited end surface, respectively.

FIG. 21 is an exploded view of the dielectric resonator apparatus of FIG. 20 placed upside down and cut horizontally by a plane passing through the central axes of the two throughholes 5*a* and 5*b*. In FIG. 21, symbols $C_s$ each indicate the capacitance between a tip part of the inner conductor 3 and the outer conductor 4 formed on the open end surface 1*a* (hereinafter referred to as the front end capacitance), and symbol $C_e$ indicates the capacitance between each inner conductor 3 and the nearer one thereto of the signal input or output electrode 9*a* or 9*b* (hereinafter referred to as the external capacitance). The front end capacitance $C_s$ can be adjusted by varying the length t to thereby control the resonance frequencies of the dielectric resonators as well as the coupling therebetween.

As shown in FIG. 22, which is a circuit diagram of an equivalent circuit of the dielectric resonator apparatus shown in FIGS. 20 and 21, this dielectric resonator apparatus may be regarded as being a structure with dielectric coaxial resonators R1 and R2 respectively formed around the throughholes 5*a* and 5*b* and connected in a so-called comb-line manner. The front end capacitance $C_s$ is deemed to be inserted between each of the dielectric coaxial resonators R1 and R2 and the grounded outer conductor 4, and the external capacitance $C_e$ is deemed to be inserted between one of the dielectric coaxial resonators R1 and the nearer one of the signal input or output electrodes 9*a* and between the other of the dielectric coaxial resonators R2 and the other of the signal input or output electrodes 9*b*.

Dielectric resonator apparatus which are structured as shown in FIG. 20 with a plurality of dielectric coaxial resonators combined together inside a single dielectric block, are advantageous in that they are generally smaller and lighter than prior art apparatus with individually discrete dielectric coaxial resonators combined together.

The pass band of a dielectric resonator apparatus shown in FIGS. 20 and 21 is determined mainly by the magnitude of the front end capacitance $C_s$ and the pitch S between the two throughholes 5*a* and 5*b*. In order to vary the pass band, therefore, one has only to change the magnitude of the front end capacitance $C_s$ and/or the pitch S. It is not possible, however, to change the magnitude of the front end capacitance $C_s$ beyond a certain limit because of physical restrictions. If the pitch S is changed, on the other hand, the external dimensions of the dielectric block 1 are affected, and the size of the dielectric blocks 1 cannot easily be standardized. In other words, dielectric blocks of different sizes will have to be prepared for different frequency characteristics, and this will adversely affect the production cost. If the pitch S is reduced in order to obtain broad band characteristics, the distance between the signal input or output electrode 9*a* and the throughhole 5*a* and that between the other signal input or output electrode 9*b* and the other throughhole 5*b* become smaller accordingly. As a result, unwanted parasitic capacitance $C_x$ (as shown in FIGS. 21 and 22) becomes too large and the symmetry of the waveforms between the dielectric coaxial resonance elements R1 and R2 becomes poor, adversely affecting the attenuation characteristic of the dielectric resonator apparatus as a whole. If the pitch S is increased in order to obtain narrowrange characteristics, on the other hand, the size of the dielectric block 1 increases, and this defeats the purpose of providing more compact resonator apparatus.

SUMMARY OF THE INVENTION

It is therefore an object of this invention to provide small and light dielectric resonator apparatus with good performance characteristics.

A dielectric resonator apparatus with a plurality of unistructurally formed dielectric coaxial resonators according to a first embodiment of the invention may be characterized as comprising not only a dielectric block with a plurality of throughholes formed therethrough and an outer conductor almost entirely covering the outer surfaces of this block, but also inner conductors formed on the inner surfaces of the throughholes so as to leave portions of the inner surfaces of the throughholes uncovered such that an end portion of each inner conductor is maintained in an electrically non-contacting relationship with the outer conductor, and means disposed between the throughholes for adjusting the degree of coupling between dielectric coaxial resonators. With a dielectric resonator apparatus thus structured, its characteristics can be adjusted by varying the degree of coupling between the dielectric coaxial resonators. The coupling-adjusting means may comprise a groove formed on the dielectric block such that the degree of coupling between the dielectric coaxial resonators can be controlled by varying the depth, width, length and/or position of the groove. If the coupling-adjusting means comprises a hole formed through the dielectric block and a conductive film formed on its inner surface and connected to the outer conductor, the degree of coupling can be controlled by varying the diameter, length and/or position of the hole. If the coupling-adjusting means comprises a slit formed on the dielectric block and having its surface covered with the outer conductor, the degree of coupling can be controlled by varying the width, length and/or position of the slit. If the coupling-adjusting means comprises an electrically conductive plate embedded in the dielectric block and electrically connected to the outer conductor, the degree of coupling can be controlled by varying the thickness, area and/or position of the conductive plate.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout the figures, components which are substantially the same are indicated by the same numerals.

DETAILED DESCRIPTION OF THE INVENTION

Figure 1A:
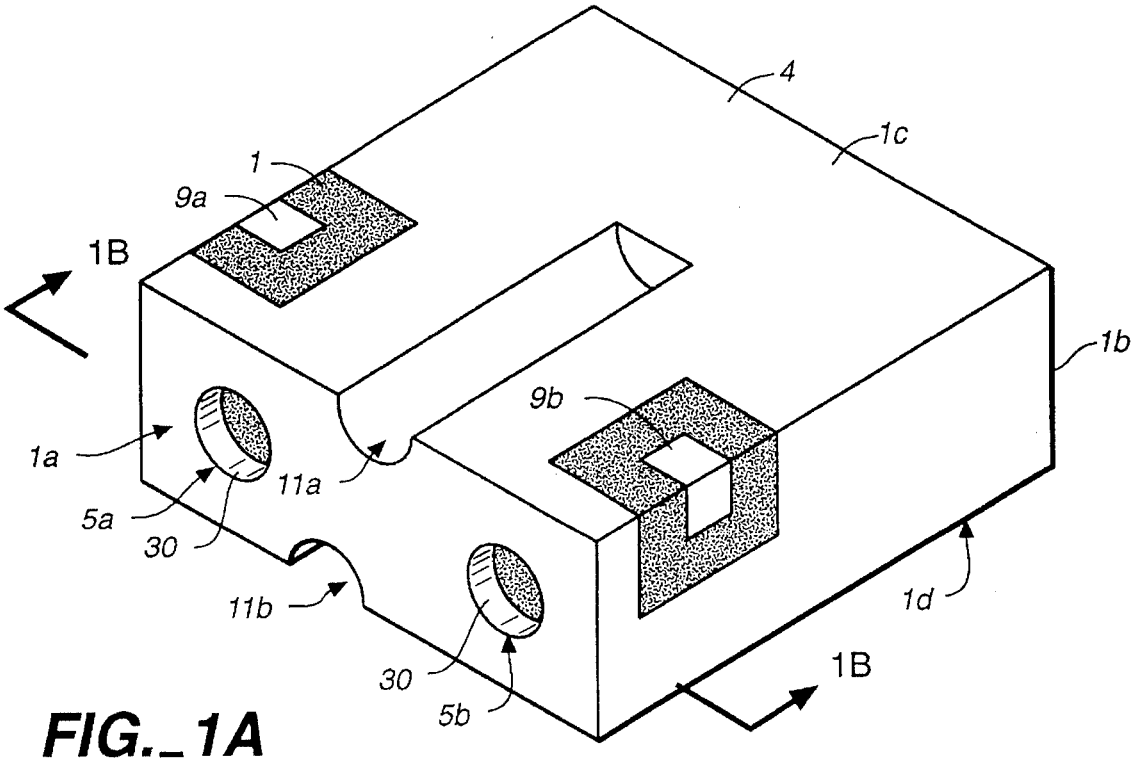
FIG. 1A is a diagonal external view of a dielectric resonator apparatus to a first embodiment of the invention.
Figure 1B:
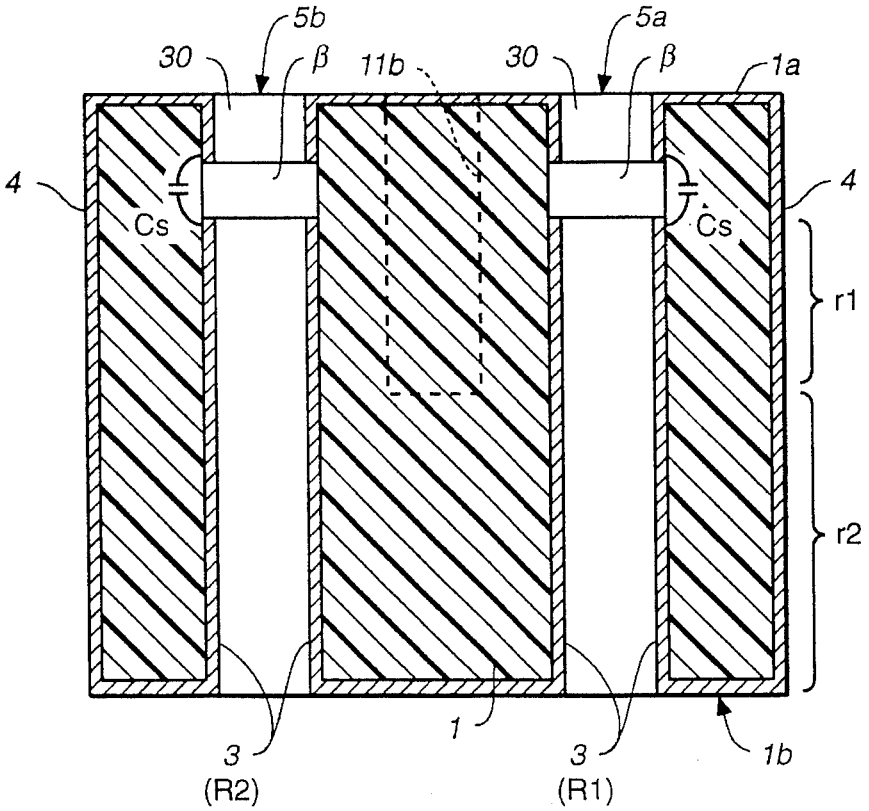
FIG. 1B is its sectional view taken along the line 1B—1B in FIG. 1A.
Figure 19:
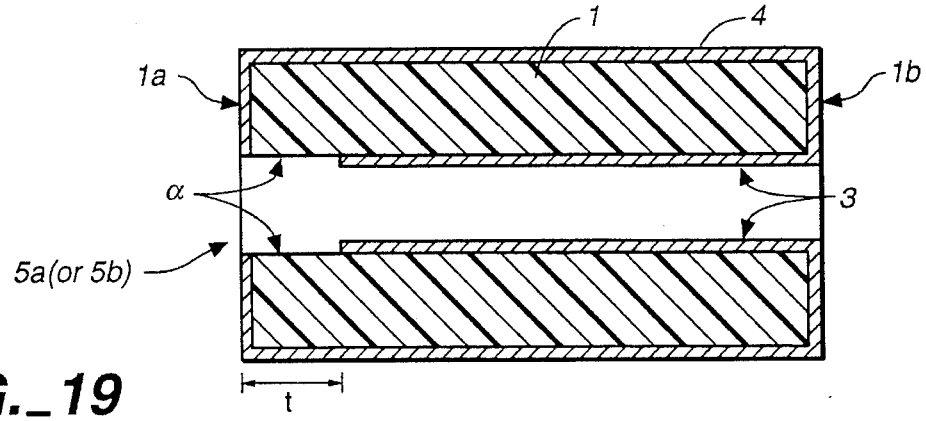
FIG. 19 is a sectional view of the dielectric resonator apparatus of FIGS. 17 and 18 after its completion.
Figure 21:
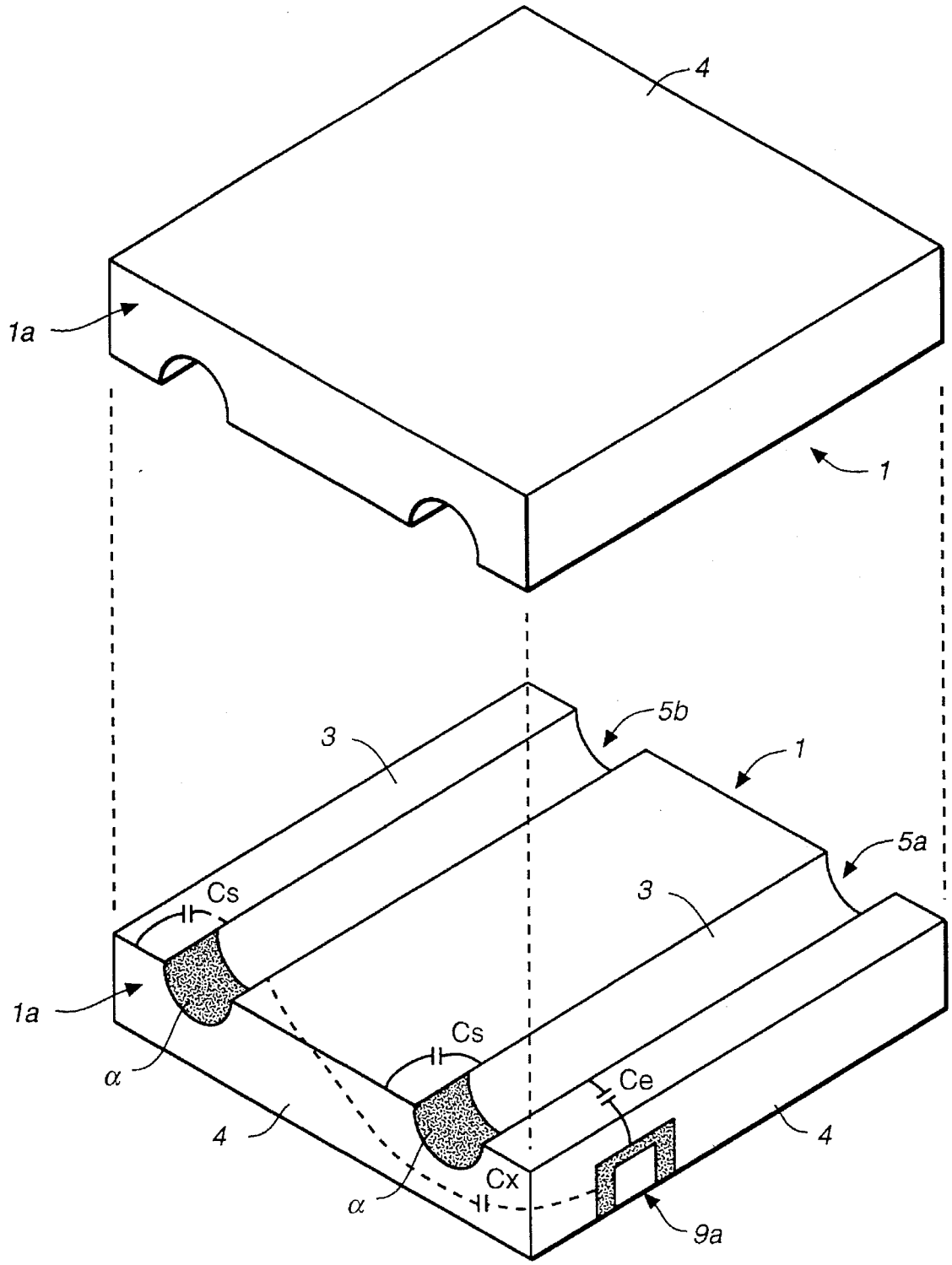
FIG. 21 is an exploded diagonal perspective view of the dielectric resonator apparatus of FIGS. 19 and 20.

As shown in FIG. 1A, a dielectric resonator apparatus according to a first embodiment of the invention comprises a dielectric block 1 which is approximately a parallelepiped in shape and has a plurality of throughholes (only a mutually adjacent pair of throughholes 5*a* and 5*b* being shown) formed therethrough, connecting its open end surface 1*a* with its short-circuited end surface 1*b*. The outer surfaces of the dielectric block 1 is nearly completely covered by an outer conductor 4. Also formed on the outer surfaces of the dielectric block 1 is a pair of signal input or output electrodes 9*a* and 9*b* which are in electrically insulated relationship with the outer conductor 4. As shown in FIG. 1B, an inner conductor 3 is formed on the inner surfaces of the throughholes 5*a* and 5*b*, leaving uncovered annular areas β which, unlike the uncovered part α shown in FIGS. 19 and 21, are not directly adjacent to the opening of the throughhole 5*a* or 5*b* to the open end surface 1*a* but are somewhat recessed therefrom. In other words, portions of the inner conductor 3 are left inside the throughholes 5*a* and 5*b* as front end conductors 30 connected to the part of the outer conductor 4 on the open end surface 1*a*. This is substantially equivalent to having parts of the outer conductor 4 folded into the throughholes 5*a* and 5*b*, and this structure is advantageous in that the leak of electromagnetic fields from the interiors of the throughholes 5*a* and 5*b* can be thereby prevented nearly completely. As indicated also in FIG. 1(B), front end capacitance $C_s$ appears between the inner conductors 3 and the front end conductors 30. Generation of external capacitance $C_e$ between the inner conductors 3 and the signal input or output electrodes 9*a* and 9*b* is indicated in the circuit diagram of its equivalent circuit shown in FIG. 2.

The dielectric resonator apparatus shown in FIGS. 1A and 1B is further characterized as having grooves 11*a* and 11*b* formed on the dielectric block 1, serving as coupling adjusting means. One of the grooves 11*a* is shown as being formed on one of the main outer surfaces of the dielectric block 1 and between the two throughholes 5*a* and 5*b*. The other groove 11*b* is formed on the other main outer surface of the dielectric block 1 and also between the two throughholes 5*a* and 5*b*. Both grooves 11*a* and 11*b* extend parallel to the throughholes 5*a* and 5*b*, starting at the open end surface 1*a* and ending at a position approximately half way between the open end surface 1*a* and the short-circuited end surface 1*b*. The inner surfaces of the grooves 11*a* and 11*b* are both covered by the outer conductor 4. Although FIGS. 1A and 1B show the grooves 11*a* and 11*b* as having a semi-circular cross-sectional shape, the cross-sections of the grooves 11*a* and 11*b* may be U-shaped, rectangular or triangular.

Figure 2:
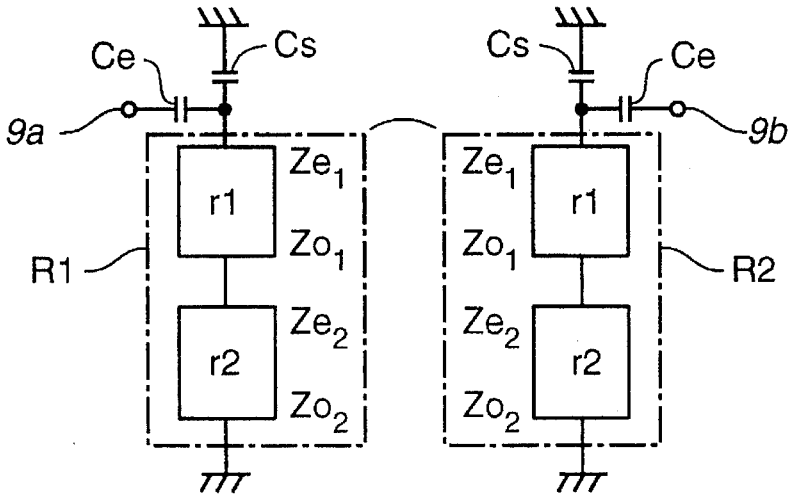
FIG. 2 is an equivalent circuit diagram of the embodiment shown in FIGS. 1A and 1B.
Figure 22:
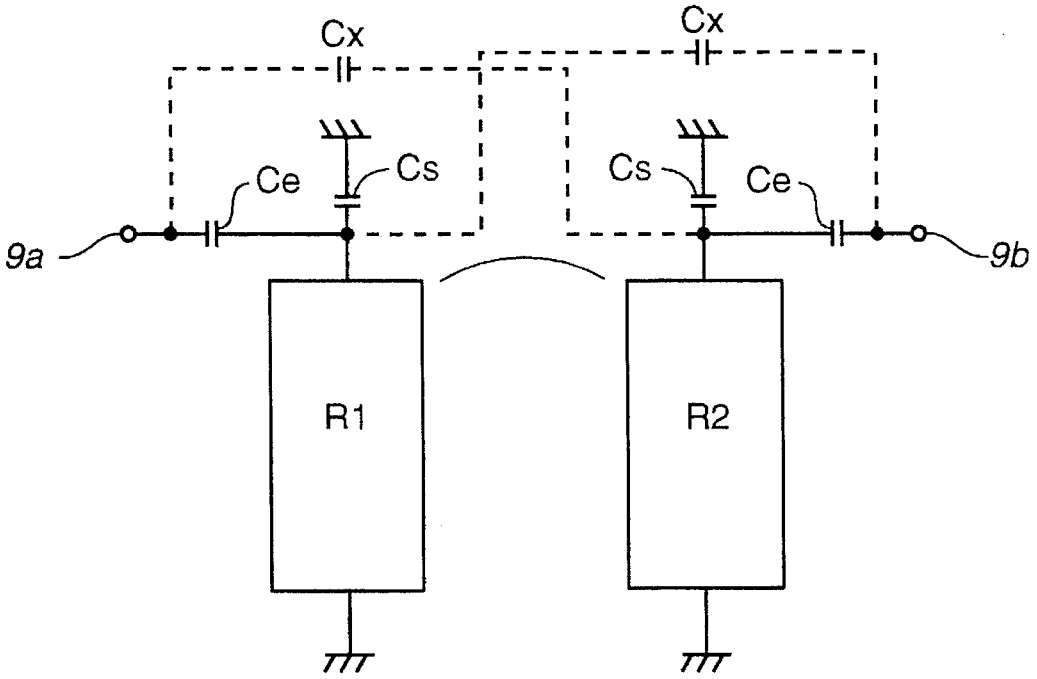
FIG. 22 is an equivalent circuit diagram of the dielectric resonator apparatus of FIGS. 19, 20 and 21.
Figure 3A:
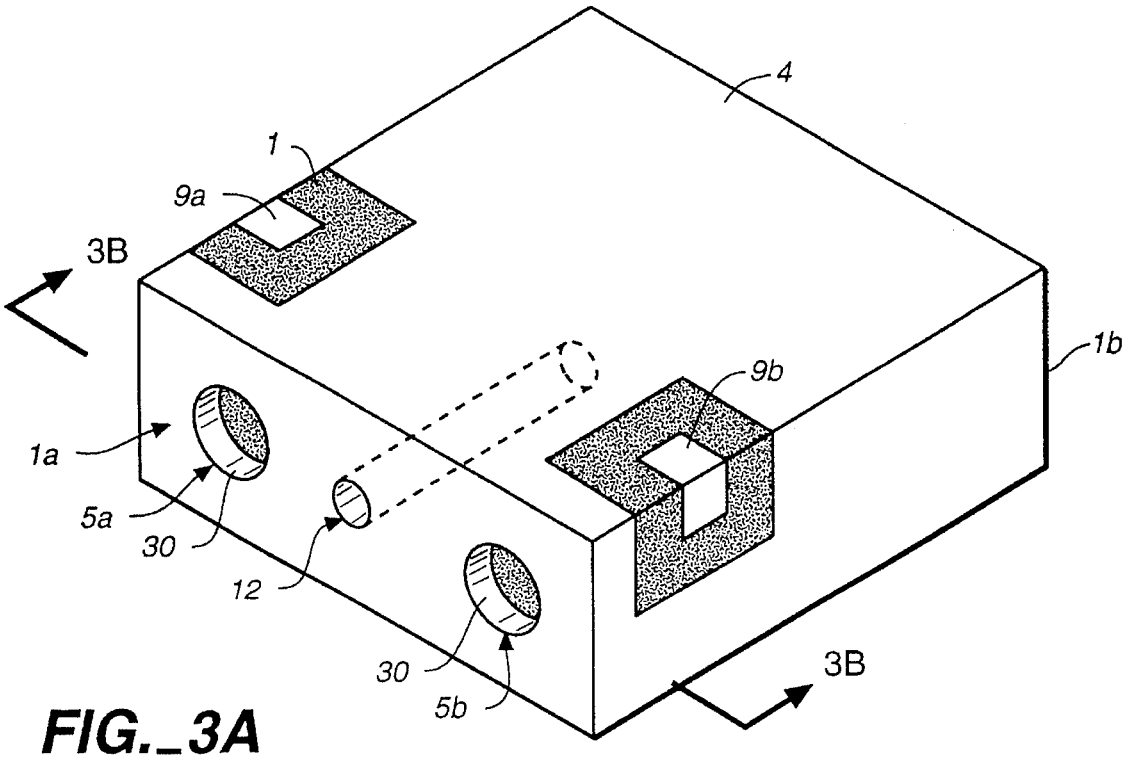
FIG. 3A is a diagonal external view of a dielectric resonator apparatus according to a second embodiment of the invention.
Figure 3B:
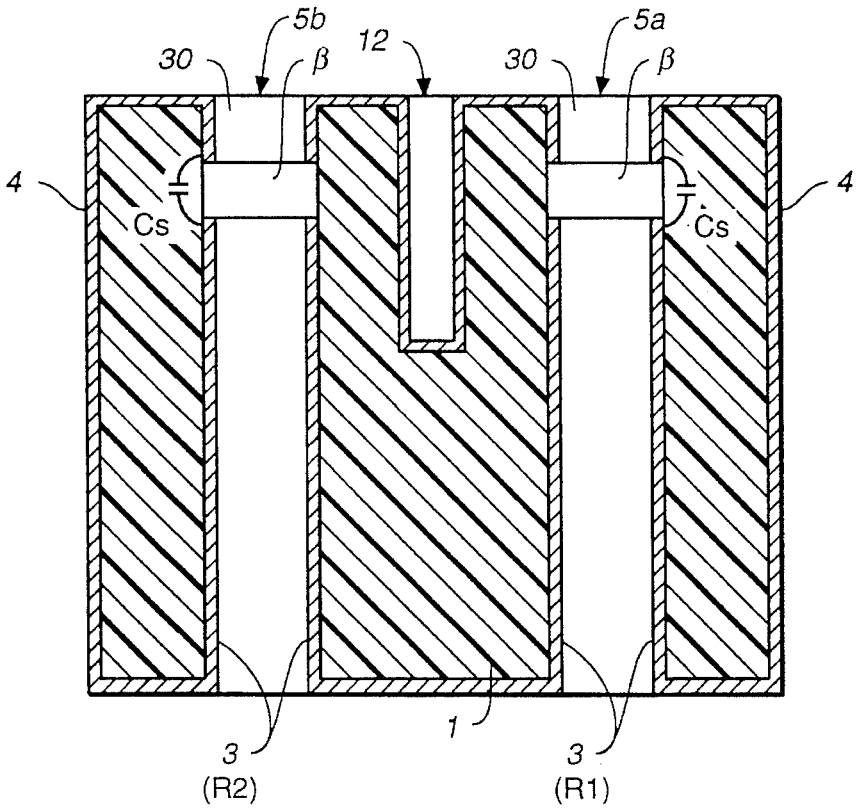
FIG. 3B is its sectional view taken along the line 3B—3B in FIG. 3A.

The dielectric resonator apparatus of FIG. 1 is structured, as shown in FIG. 2 which is its equivalent circuit diagram, as a so-called comb-line coupling of the dielectric coaxial resonators R1 and R2 respectively formed around the throughholes 5*a* and 5*b*. Because of the grooves 11*a* and 11*b* provided between the two dielectric coaxial resonators R1 and R2 affect the impedance in the longitudinal direction, each of the dielectric coaxial resonators R1 and R2 may be considered as each having a first resonance section r1 near which the grooves 11*a* and 11*b* are provided and a second resonance section r2 which is farther away from the grooves 11*a* and 11*b* (as also shown schematically in FIG. 1B). If the values of characteristic impedance of the first resonance section r1 in even and odd modes are respectively $Ze_1$ and $Zo_1$, and if those of the second resonance section r2 in even and odd modes are respectively $Ze_2$ and $Zo_2$, $Ze_1/Ze_2$ is smaller than $Zo_1/Zo_2$ for the dielectric resonator apparatus shown in FIG. 1. As a result, inductive coupling becomes stronger and the pass band becomes broader. Since the degree of inductive coupling between the dielectric coaxial resonators R1 and R2 varies as the lengths, widths, positions and cross-sectional shapes of the grooves 11*a* and 11*b* are changed, the pass band characteristics can be adjusted without changing the pitch between the throughholes 5*a* and 5*b*, that is, without changing the external dimensions of the dielectric block 1. In other words, the dielectric block 1 can be standardized and made compact. Moreover, since the grooves 11*a* and 11*b* provide air-filled gaps between the dielectric coaxial resonators R1 and R2, the parasitic capacitance $C_e$ as shown in FIG. 22 can be reduced. Accordingly, the asymmetry in the attenuation characteristics between the dielectric coaxial resonators R1 and R2 can be improved and, as a further result, the attenuation characteristics of the dielectric resonator apparatus as a whole can be improved. FIGS. 3A and 3B show a dielectric resonator apparatus according to a second embodiment of the invention characterized as having a bottomed hole 12 (that is, not a throughhole) formed between the throughholes 5*a* and 5*b* inside the dielectric block 1, instead of the grooves 11*a* and 11*b* of FIGS. 1A and 1B, serving as coupling adjusting means. This bottomed hole 12 extends parallel to the throughholes 5*a* and 5*b*, starting from the open end surface 1*a* of the dielectric block 1 and ending at the bottom which is approximately half way between the open end surface 1*a* and the short-circuited end surface 1*b*. A conductive film connected to the outer conductor 4 is formed on the inner surface of the bottomed hole 12. In other aspects, the embodiment shown in FIGS. 3A and 3B is the same as that shown in FIGS. 1A and 1B, and corresponding parts are indicated by the same numerals. The cross-sectional shape of the bottomed hole 12 is not limited to be circular but may be different, such as polygonal or elliptical.

The bottomed hole 12 of the embodiment in FIGS. 3A and 3B, like the grooves 11*a* and 11*b* shown in FIGS. 1A and 1B, serves to make the inductive coupling stronger between the two dielectric coaxial resonators R1 and R2, that is, to broaden the pass band of the dielectric resonator apparatus of FIGS. 3A and 3B. Since the degree of this inductive coupling varies according to the length, diameter, position, etc. of the bottomed hole 12, it is possible to adjust the band pass characteristics without changing the external dimensions of the dielectric block 1.

Figure 4A:
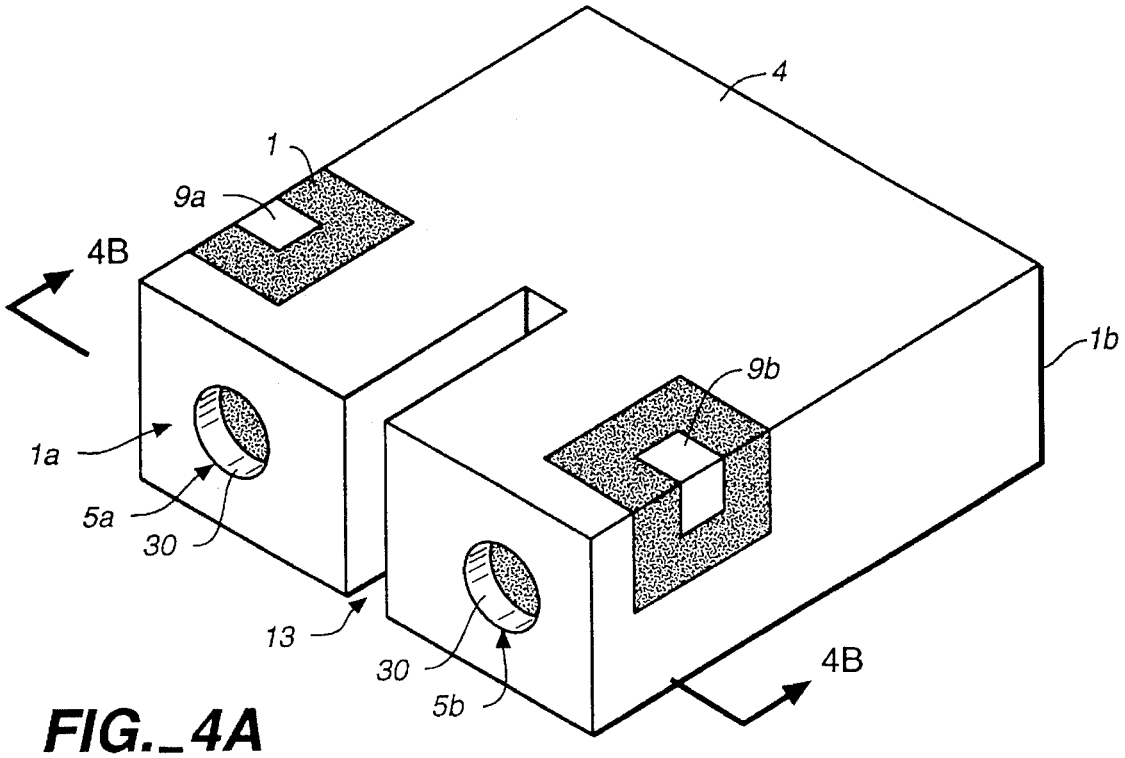
FIG. 4A is a diagonal external view of a dielectric resonator apparatus according to a third embodiment of the invention.
Figure 4B:
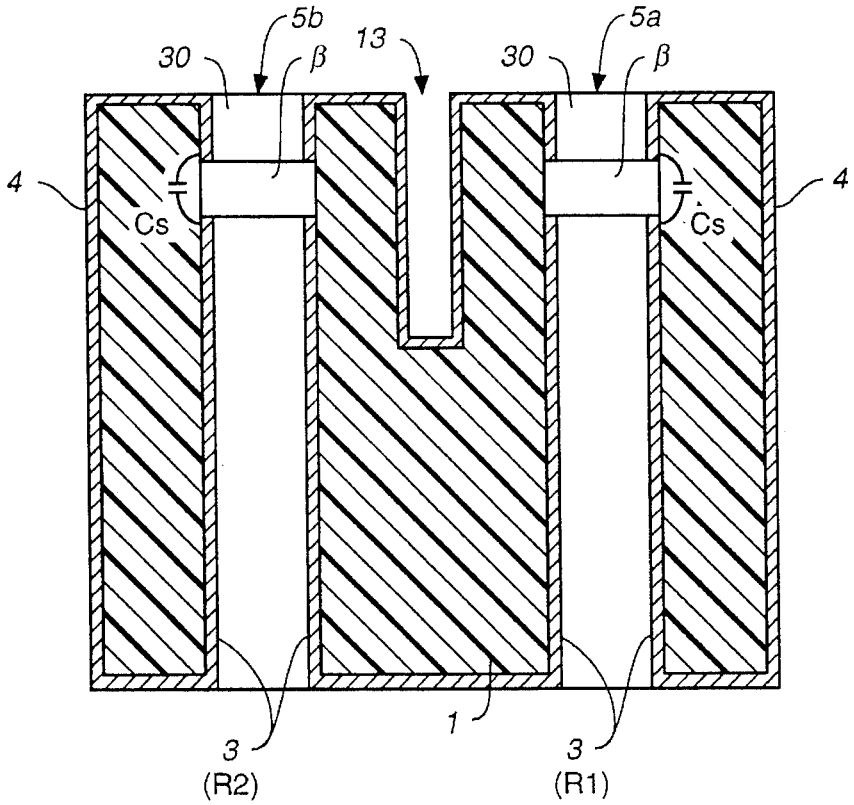
FIG. 4B is its sectional view taken along the line 4B—4B in FIG. 4A.

FIGS. 4A and 4B show a dielectric resonator apparatus according to a third embodiment of the invention characterized as having a slit 13 formed between the throughholes 5*a* and 5*b* in the dielectric block 1, serving as coupling adjusting means. This slit 13 extends parallel to the throughholes 5*a* and 5*b*, starting from the open end surface 1*a* of the dielectric block 1 and ending at a position approximately half way between the open end surface 1*a* and the short-circuited end surface 1*b*. The inner surface of the slit 13 is covered by the outer conductor 4. In other aspects, the embodiment shown in FIGS. 4A and 4B is the same as that shown in FIGS. 1A and 1B, and corresponding parts are indicated by the same numerals.

The slit 13 of the embodiment in FIGS. 4A and 4B serves to make the inductive coupling stronger between the two dielectric coaxial resonators R1 and R2, that is, to broaden the pass band of the dielectric resonator apparatus of FIGS. 4A and 4B. Since the degree of this inductive coupling varies according to the length, width, position, etc. of the slit 13, it is possible to adjust the band pass characteristics without changing the external dimensions of the dielectric block 1.

Figure 5A:
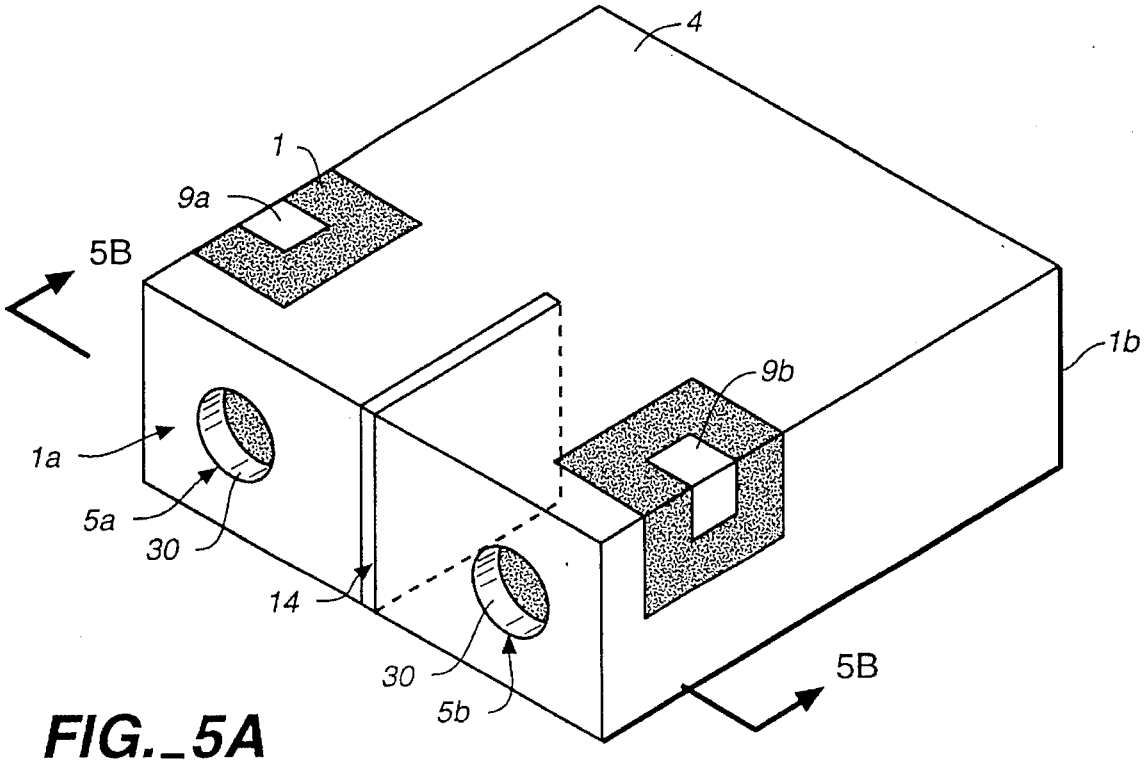
FIG. 5A is a diagonal external view of a dielectric resonator apparatus according to a fourth embodiment of the invention.
Figure 5B:
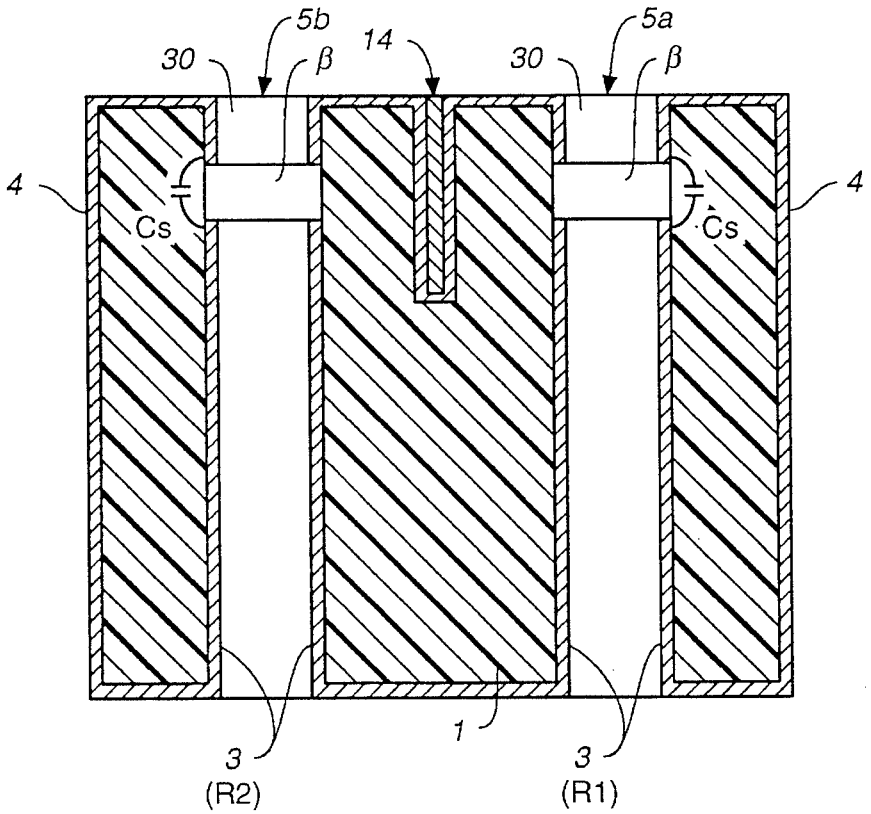
FIG. 5B is its sectional view taken along the line 5B—5B in FIG. 5A.

FIGS. 5A and 5B show a dielectric resonator apparatus according to a fourth embodiment of the invention characterized as having a conductive plate 14 buried between the throughholes 5*a* and 5*b* in the dielectric block 1, serving as coupling adjusting means. This conductive plate 14 extends parallel to the throughholes 5*a* and 5*b*, starting from the open end surface 1*a* of the dielectric block 1 and ending at a position approximately half way between the open end surface 1*a* and the short-circuited end surface 1*b*. Such a dielectric resonator apparatus can be obtained, for example, by inserting the conductive plate 14 between two divided dielectric blocks before they are sintered, compressing these dielectric blocks together to make a single body and sintering this unified block and the conductive plate 14 together at the same time. In other aspects, the embodiment shown in FIGS. 5A and 5B is the same as that shown in FIGS. 1A and 1B, and corresponding parts are indicated by the same numerals.

The conductive plate 14 the embodiment in FIGS. 5A and 5B serves to make the inductive coupling stronger between the two dielectric coaxial resonators R1 and R2, that is, to broaden the pass band of the dielectric resonator apparatus of FIGS. 5A and 5B. Since the degree of this inductive coupling varies according to the area, thickness, position, etc. of the conductive plate 14, it is possible to adjust the band pass characteristics without changing the external dimensions of the dielectric block 1.

Figure 6A:
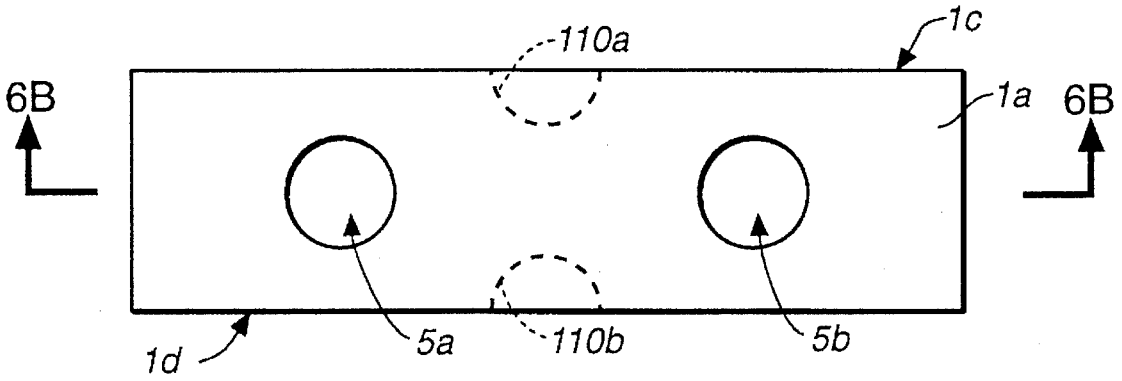
FIG. 6A is a front view of a dielectric resonator apparatus according to a fifth embodiment of the invention.
Figure 6B:
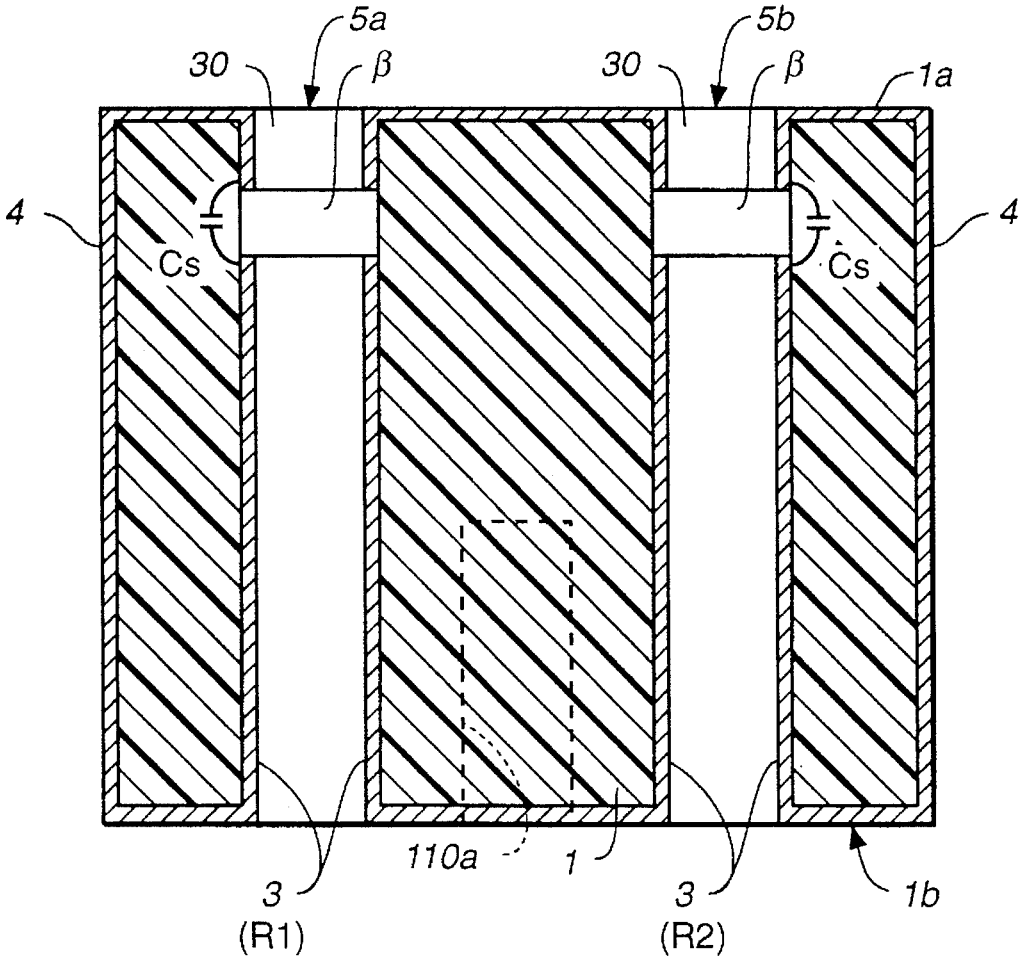
FIG. 6B is its sectional view taken along the line 6B—6B in FIG. 6A.

FIGS. 6A and 6B show a dielectric resonator apparatus according to a fifth embodiment of the invention characterized as having grooves 110*a* and 110*b* formed on the two mutually opposite major surfaces 1*c* and 1*d* of the dielectric block 1, serving as coupling adjusting means. These grooves 110*a* and 110*b*, unlike the grooves 11*a* and 11*b* of the first embodiment of the invention shown in FIGS. 1A and 1B, are formed adjacent to the short-circuited end surface 1*b* of the dielectric block 1. In other words, the grooves 110*a* and 110*b* both start from the short-circuited end surface 1*b* and end somewhere about half way between the open end surface 1*a* and the short-circuited end surface 1*b*. The inner surfaces of the grooves 110*a* and 110*b* are covered with the outer conductor 4. In other aspects, the embodiment shown in FIGS. 6A and 6B is the same as that shown in FIGS. 1A and 1B, and corresponding parts are indicated by the same numerals.

Because the grooves 110*a* and 110*b* are on the side of the short-circuited end surface 1*b*, $Ze_1/Ze_2$ is greater than $Zo_1/Zo_2$ in the case of the dielectric resonator apparatus shown in FIGS. 6A and 6B, where $Ze_1$, $Ze_2$, $Zo_1$ and $Zo_2$ are as defined above. As a result, the inductive coupling between the dielectric coaxial resonators R1 and R2 is weakened and the pass band becomes narrower. Since the degree of this inductive coupling varies according to the lengths, widths, depths, cross-sectional shapes, etc. of the grooves 110*a* and 110*b*, it is possible to adjust the band pass characteristics without changing the external dimensions of the dielectric block 1.

Figure 7A:
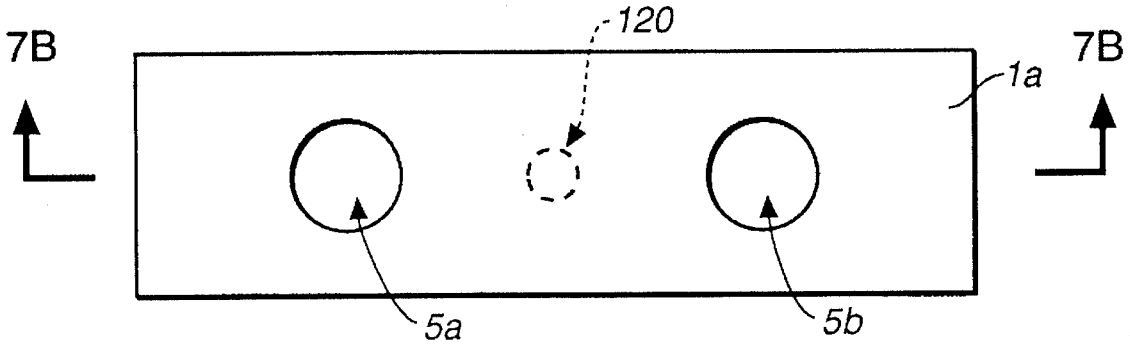
FIG. 7A is a front view of a dielectric resonator apparatus according to a sixth embodiment of the invention.
Figure 7B:
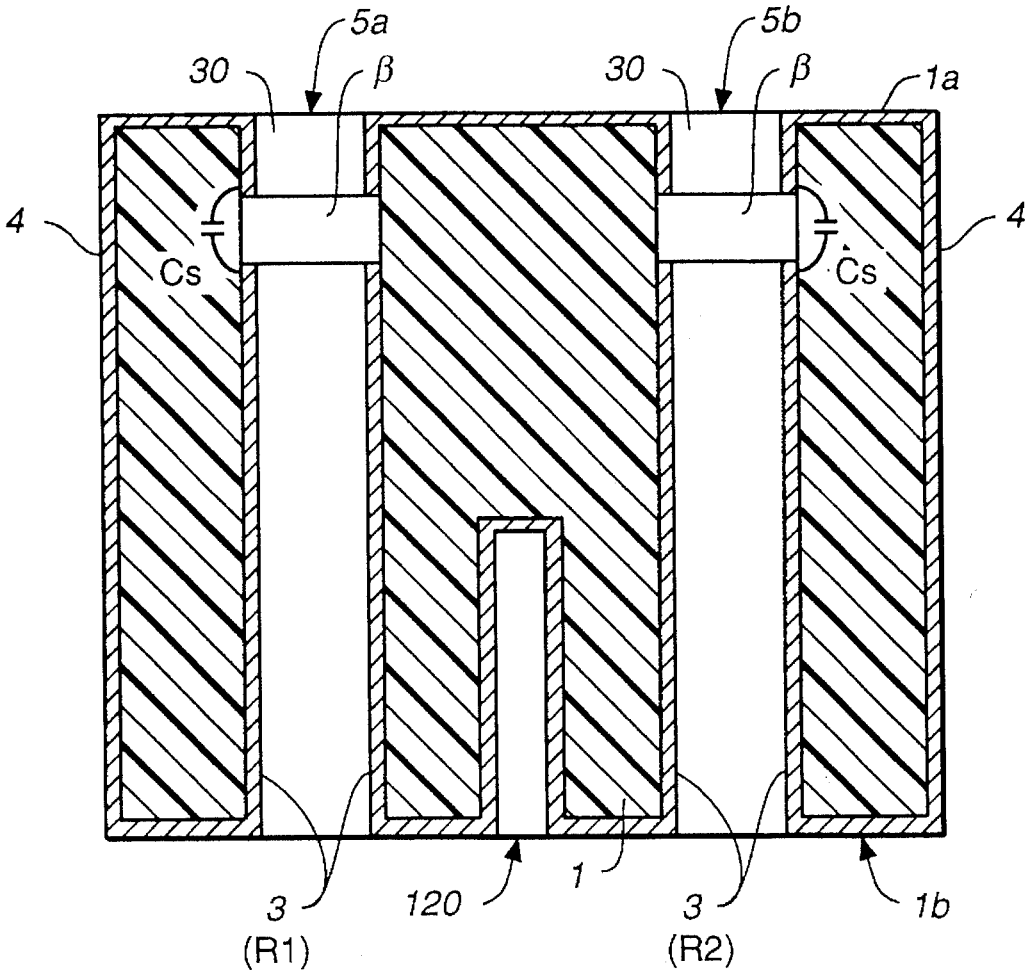
FIG. 7B is its sectional view taken along the line 7B—7B in FIG. 7A.

FIGS. 7A and 7B show a dielectric resonator apparatus according to a sixth embodiment of the invention characterized as having a bottomed hole 120 formed between the throughholes 5*a* and 5*b* inside the dielectric block 1, serving as coupling adjusting means. This bottomed hole 120, unlike the bottomed hole 12 shown in FIGS. 3A and 3B, is formed on the side of the short-circuited end surface 1*b* of the dielectric block 1. A conductive film connected to the outer conductor 4 is formed on the inner surface of the bottomed hole 120. In other aspects, the embodiment shown in FIGS. 7A and 7B is the same as that shown in FIGS. 1A and 1B, and corresponding parts are indicated by the same numerals.

Because the bottomed hole 120 is formed from the short-circuited end surface 1*b*, it has the same effect as the grooves 110*a* and 110*b* shown in FIGS. 6A and 6B, causing the inductive coupling between the dielectric coaxial resonators R1 and R2 to become weaker. Accordingly, the pass band of the dielectric resonator apparatus shown in FIG. 7A and 7B becomes narrower. Since the degree of this inductive coupling varies according to the length, diameter, position, etc. of the bottomed hole 120, it is possible to adjust the band pass characteristics without changing the external dimensions of the dielectric block 1.

Figure 8A:
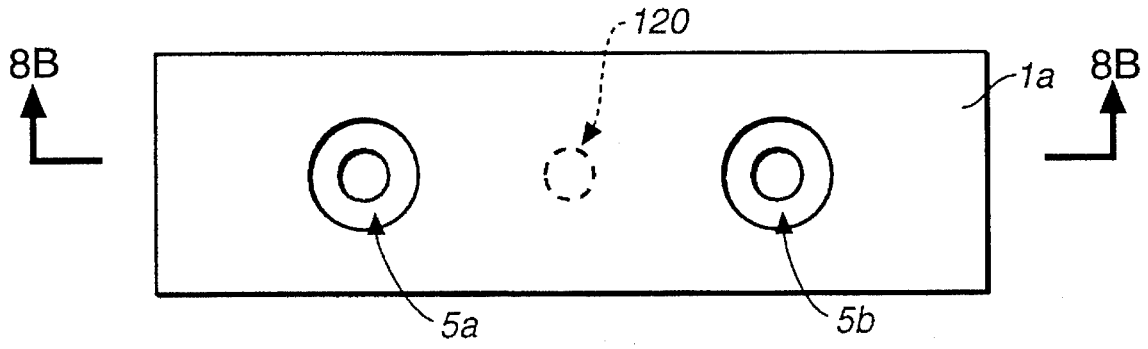
FIG. 8A is a front view of a dielectric resonator apparatus according to a seventh embodiment of the invention.
Figure 8B:
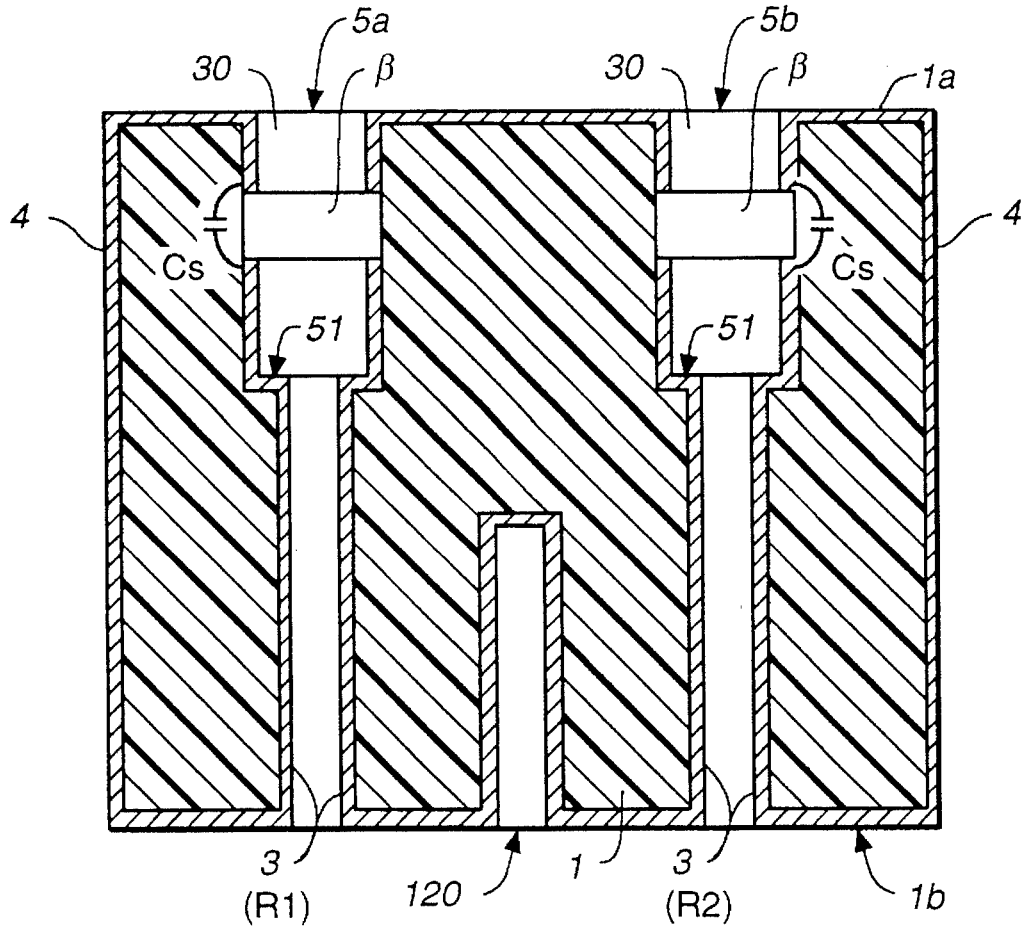
FIG. 8B is its sectional view taken along the line 8B—8B in FIG. 8A.

FIGS. 8A and 8B show a dielectric resonator apparatus according to a seventh embodiment of the invention characterized as having a step 51 inside each of the throughholes 5*a* and 5*b* of the embodiment shown in FIGS. 7A and 7B, the rest being the same as the sixth embodiment. With the steps 51 thus formed, the dielectric coaxial resonators R1 and R2 of the dielectric resonator apparatus shown in FIGS. 8A and 8B are capacitively coupled. Thus, its pass band is already narrow, and since the bottomed hole 120 serves to increase the degree of this capacitive coupling, it is possible to obtain a dielectric resonator part with an extremely narrow pass band.

Figure 9A:
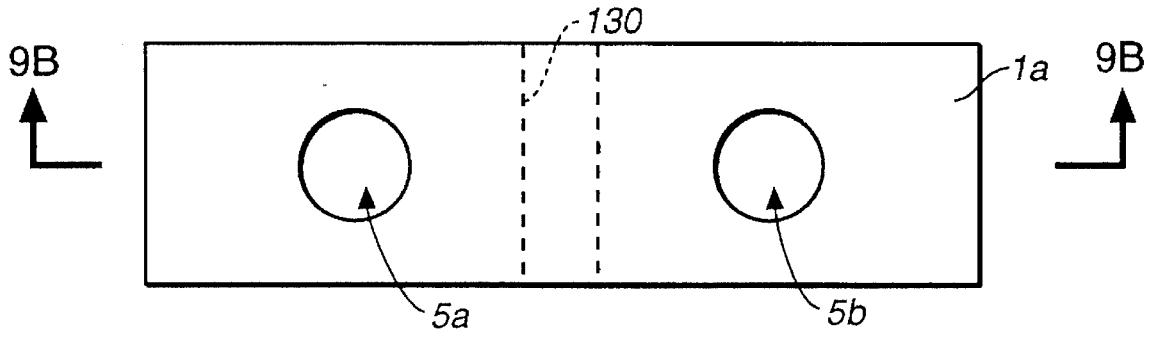
FIG. 9A is a front view of a dielectric resonator apparatus according to an eighth embodiment of the invention.
Figure 9B:
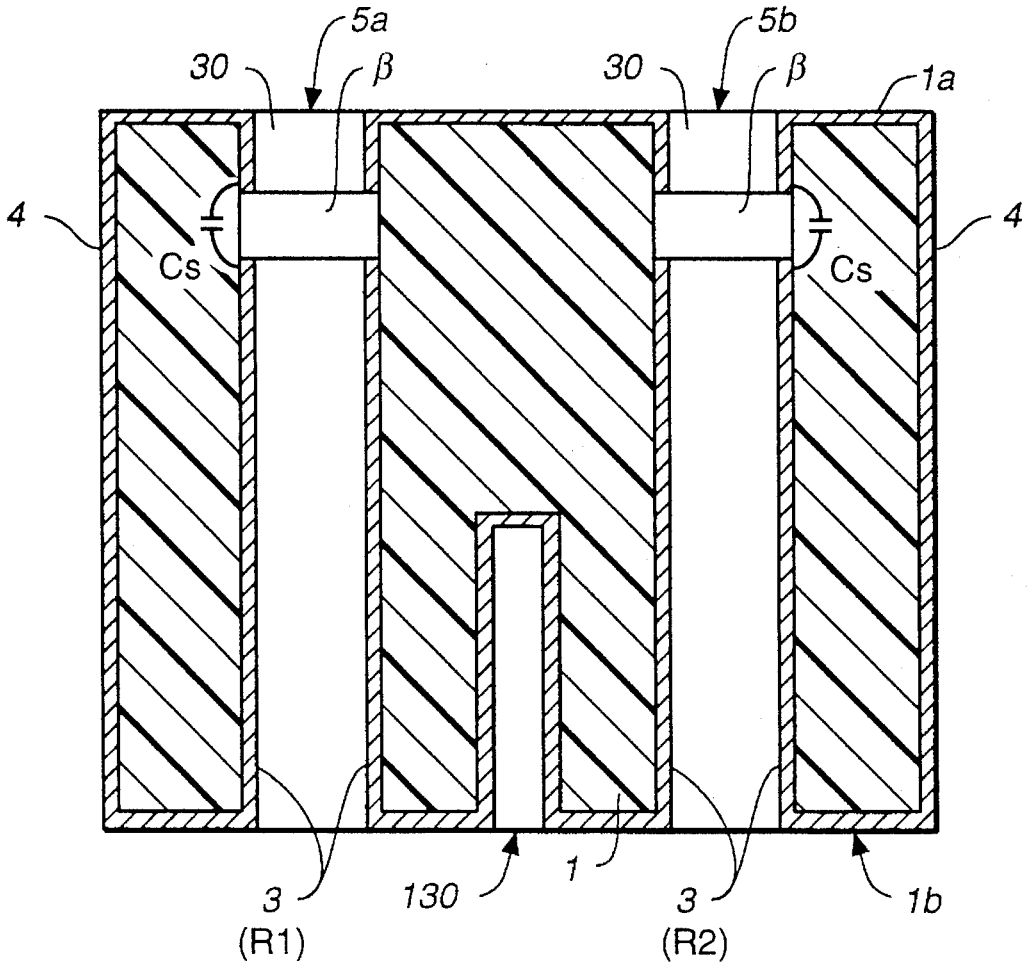
FIG. 9B is its sectional view taken along the line 9B—9B in FIG. 9A.

FIGS. 9A and 9B show a dielectric resonator apparatus according to an eighth embodiment of the invention characterized as having a slit 130 formed between the throughholes 5*a* and 5*b* in the dielectric block 1. The slit 130, unlike the slit 13 of the third embodiment of the invention, is formed on the short-circuited end surface 1*b* of the dielectric block 1. The inner surfaces of the slit 130 are covered by the outer conductor 4. In other aspects, the embodiment shown in FIGS. 9A and 9B is the same as that shown in FIGS. 4A and 4B, and corresponding parts are indicated by the same numerals.

Because the slit 130 is formed on the short-circuited end surface 1*b*, it has the effect of weakening the inductive coupling between the dielectric coaxial resonators R1 and R2. Accordingly, the pass band of the dielectric resonator apparatus shown in FIG. 9A and 9B becomes narrower. Since the degree of this inductive coupling varies according to the length, width, position, etc. of the slit 130, it is possible to adjust the band pass characteristics without changing the external dimensions of the dielectric block 1.

Figure 10A:
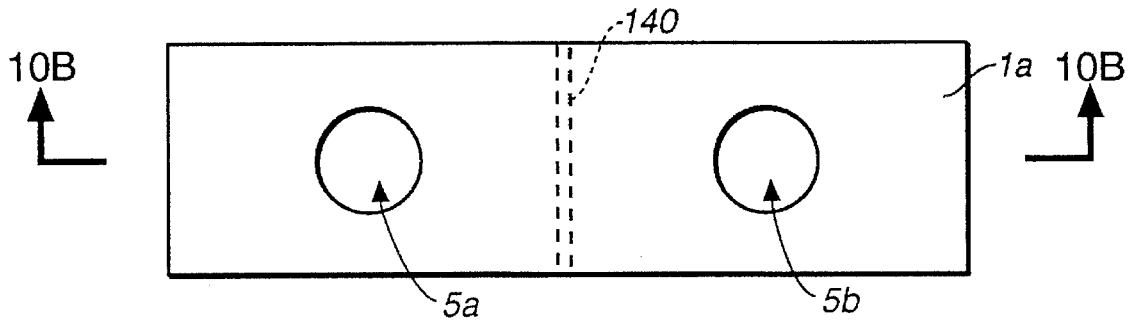
FIG. 10A is a front view of a dielectric resonator apparatus according to a ninth embodiment of the invention.
Figure 10B:
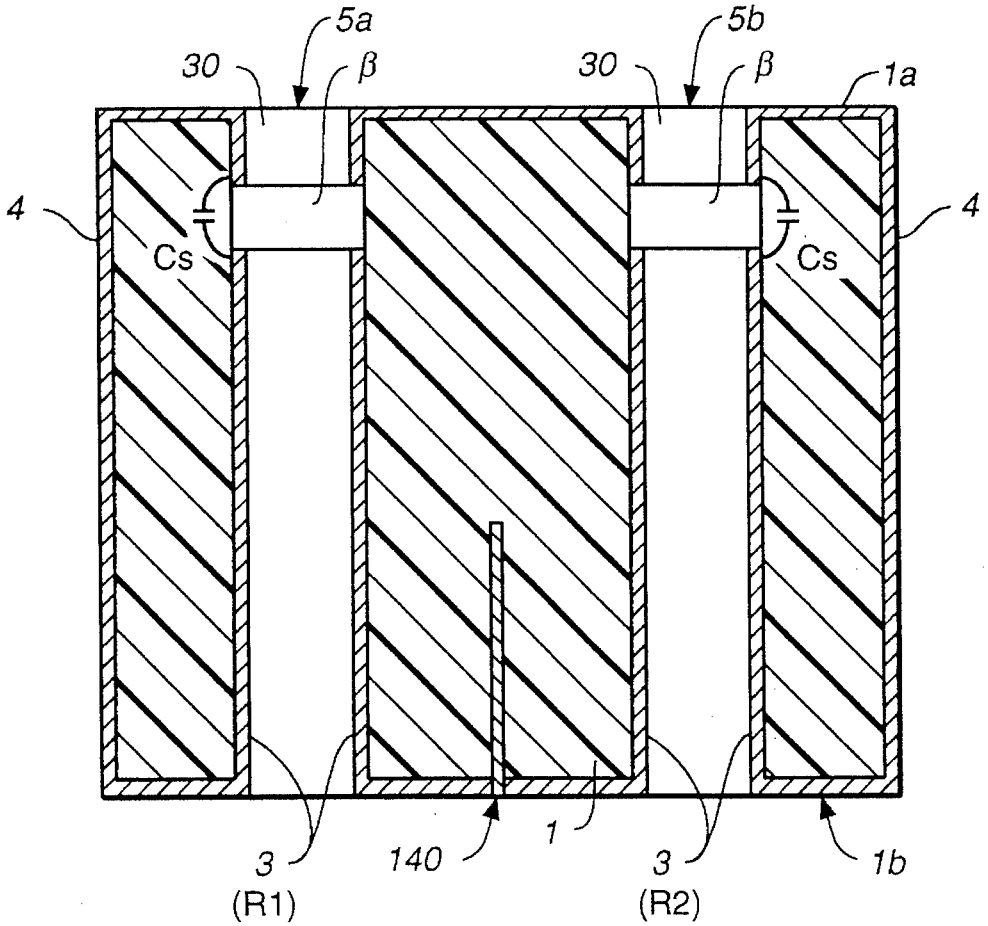
FIG. 10B is its sectional view taken along the line 10B—10B in FIG. 8A.

FIGS. 10A and 10B show a dielectric resonator apparatus according to a ninth embodiment of the invention characterized as having a conductive plate 140 buried between the throughholes 5*a* and 5*b* in the dielectric block 1. The conductive plate 140, unlike the conductive plate 14 of the fourth embodiment of the invention, is buried into the short-circuited end surface 1*b* of the dielectric block 1. In other aspects, the embodiment shown in FIGS. 10A and 10B is the same as that shown in FIGS. 5A and 5B, and corresponding parts are indicated by the same numerals.

Because the conductive plate 140 is buried into the short-circuited end surface 1*b*, it has the effect of weakening the inductive coupling between the dielectric coaxial resonators R1 and R2. Accordingly, the pass band of the dielectric resonator apparatus shown in FIG. 10A and 10B becomes narrower. Since the degree of this inductive coupling varies according to the area, thickness, position, etc. of this conductive plate 140, it is possible to adjust the band pass characteristics without changing the external dimensions of the dielectric block 1.

Figure 11A:
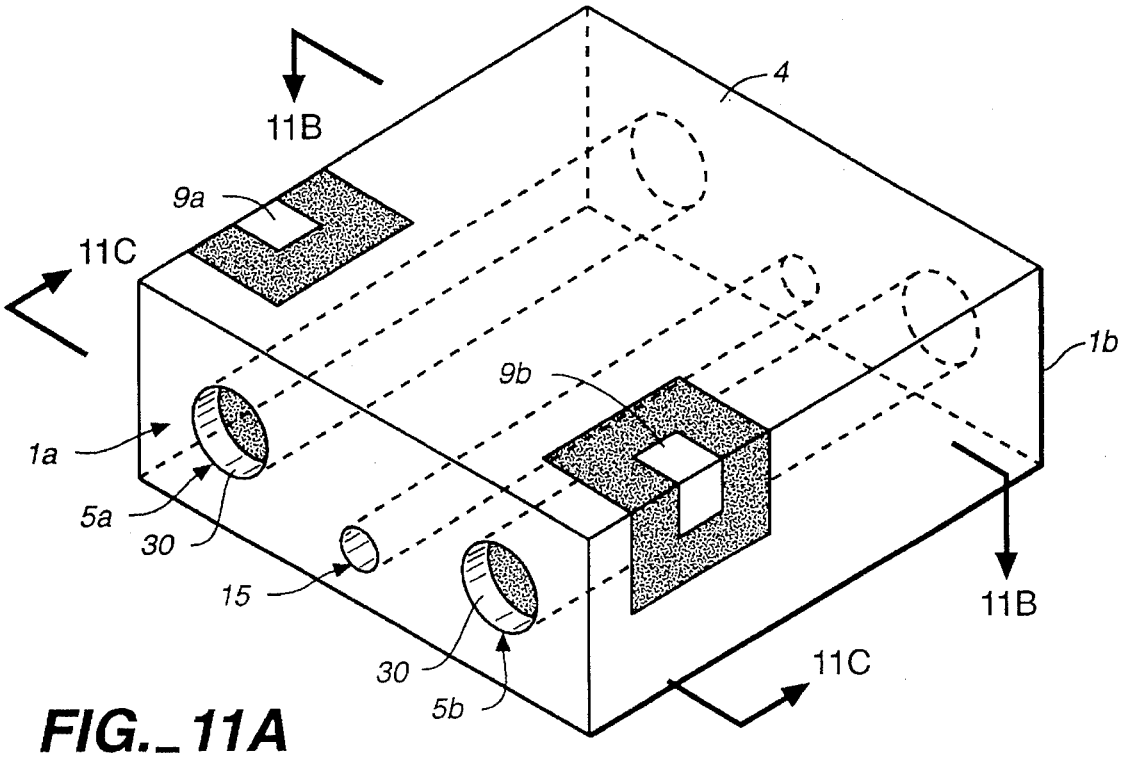
FIG. 11A is a front view of a dielectric resonator apparatus according to a tenth embodiment of the invention.
Figure 11C:
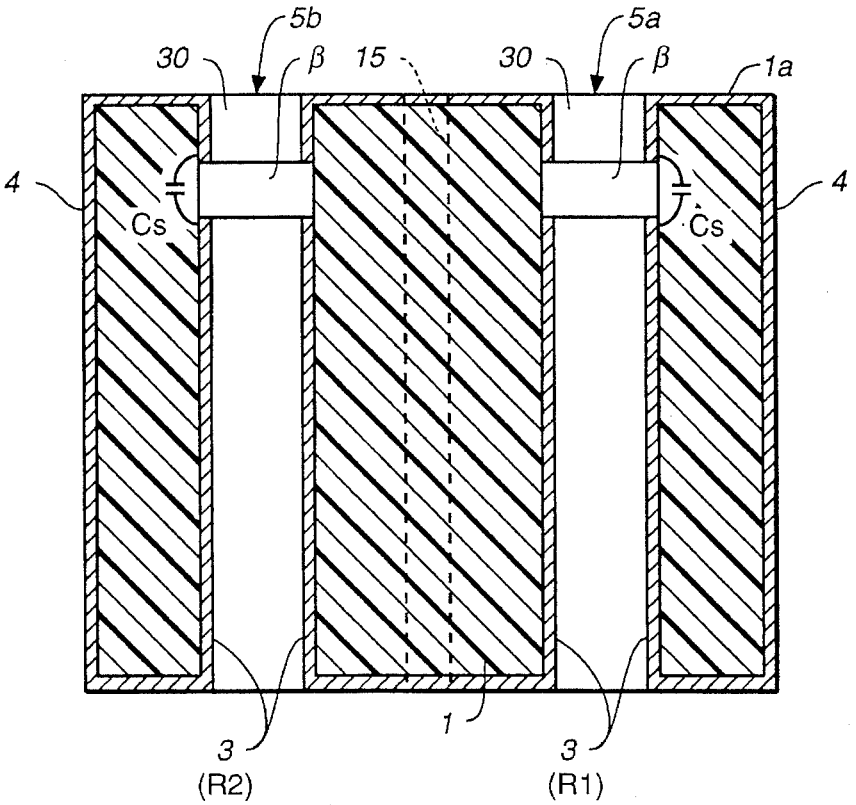
FIG. 11C is its horizontal sectional view taken along the line 11C—11C in FIG. 11A.
Figure 11B:
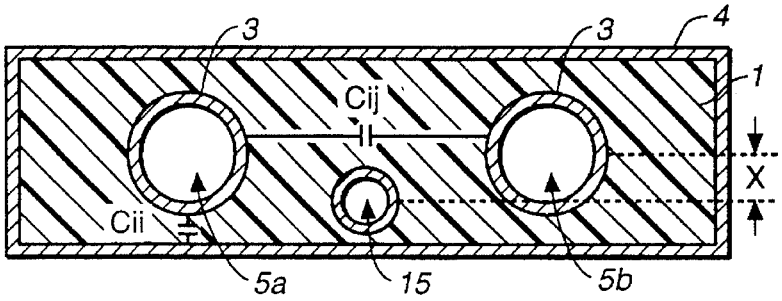
FIG. 11B is its vertical sectional view taken along the line 11B—11B in FIG. 11A.

FIGS. 11A, 11B and 11C show a dielectric resonator apparatus according to a tenth embodiment of the invention characterized as having another throughhole 15 formed between and parallel to the throughholes 5*a* and 5*b* through the dielectric block 1. The inner surface of this additional throughhole 15 is covered with a conductive film connected to the outer conductor 4. In other aspects, the tenth embodiment is the same as the sixth embodiment shown in FIGS. 7A and 7B, and corresponding parts are indicated by the same numerals.

With the throughhole 15 thus formed additionally with its inner surface grounded, the self capacitance $C_{ii}$ of the dielectric coaxial resonators R1 and R2 increases while their mutual capacitance $C_{ij}$ decreases, the inductive coupling therebetween thereby becoming weaker. This is an equivalent result obtainable by reducing the pitch between the throughholes 5*a* and 5*b*, and the pass band characteristic of the dielectric resonator part becomes narrower. Since the degree to which the inductive coupling is weakened depends on the size and position of the throughhole 15, as well as the distance x (as indicated in FIG. 11B) between the central axis of the additional throughhole 15 and the plane defined by the central axes of the throughholes 5*a* and 5*b*. In other words, since the degree of the coupling can be varied by changing the position and size of the throughhole 15, it is possible to adjust the band pass characteristics without changing the external dimensions of the dielectric block 1.

Figure 12A:
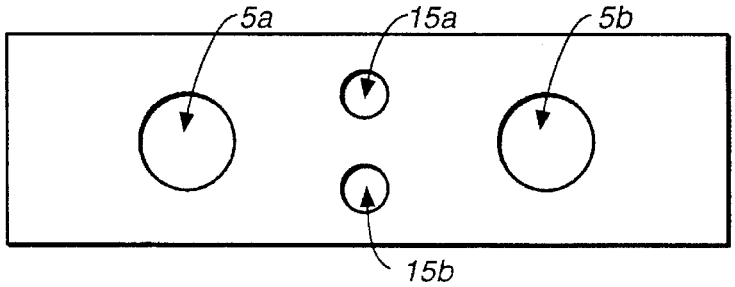
FIGS. 12A, 12B, 12C and 12D are sectional views of dielectric resonator apparatus according to variations on the tenth embodiment of the invention shown in FIGS. 11A, 11B and 11C.
Figure 12B:
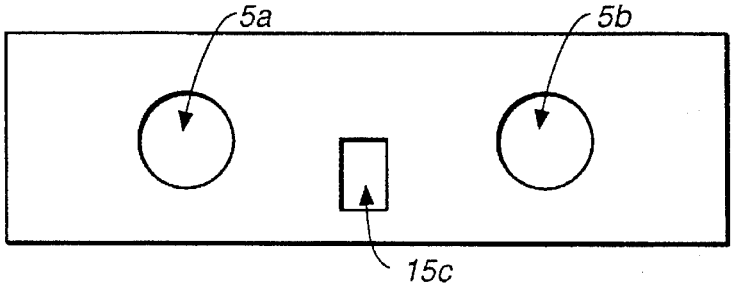
Figure 12C:
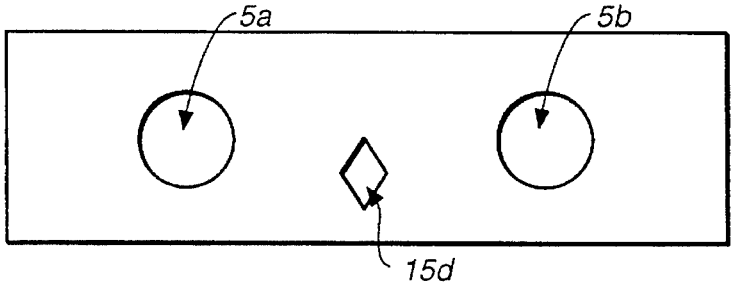
Figure 12D:
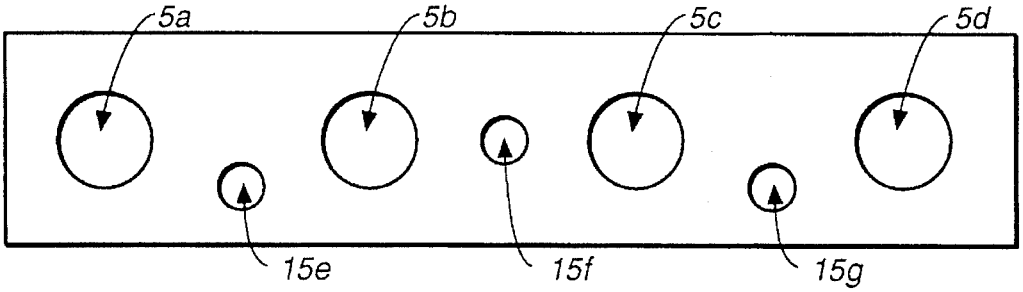

Although FIGS. 11A, 11B and 11C show only one additional throughhole 15 between the pair of throughholes 5*a* and 5*b*, two additional throughholes 15*a* and 15*b* may be provided as shown in FIG. 12A as a variation of the tenth embodiment of the invention. As further variations, FIGS. 12B and 12C show examples with a rectangularly and diamond shaped cross-section 15*c* and 15*d*, respectively, in order to effectively weaken the degree of coupling. In the case of dielectric resonator apparatus with four or more coaxial resonance elements such as shown in FIG. 12D, the positions of the additional throughholes 15*e*, 15*f* and 15*g* may be each varied with respect to the throughholes 5*a*, 5*b*, 5*c* and 5*d*. In this manner, it is possible to produce compact dielectric resonator parts with coaxial resonators at equal intervals.

Figure 13A:
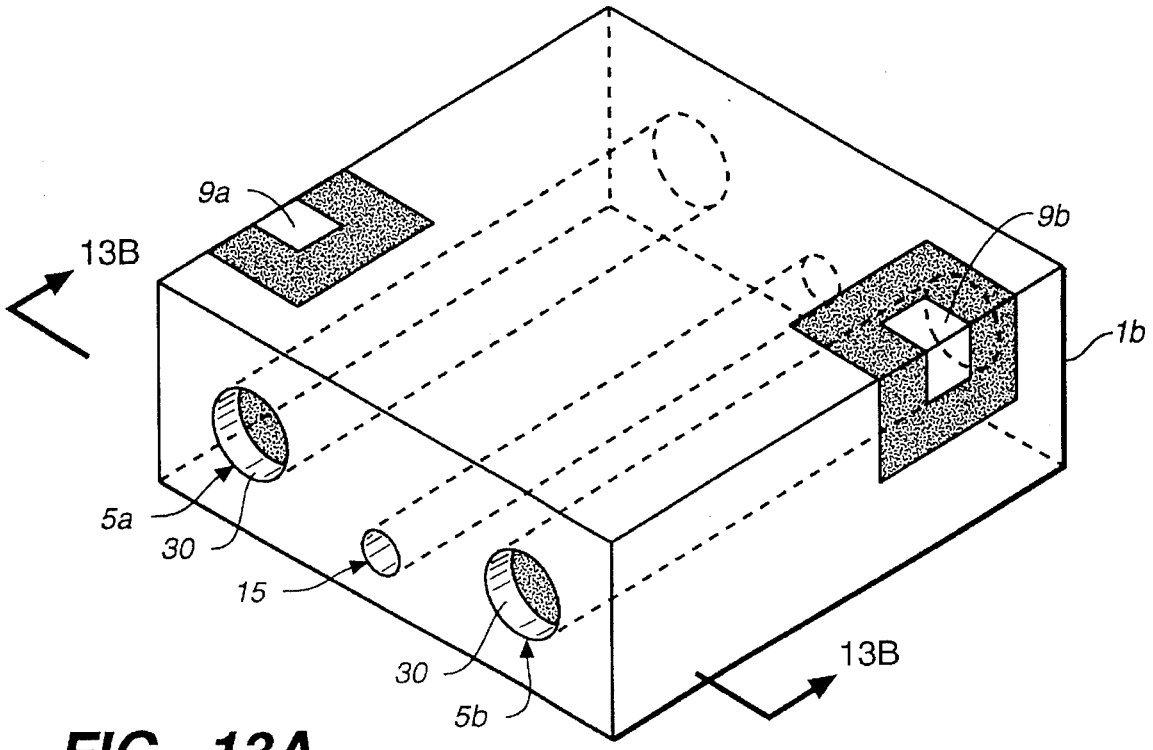
FIG. 13A is a front view of a dielectric resonator apparatus according to an eleventh embodiment of the invention.
Figure 13B:
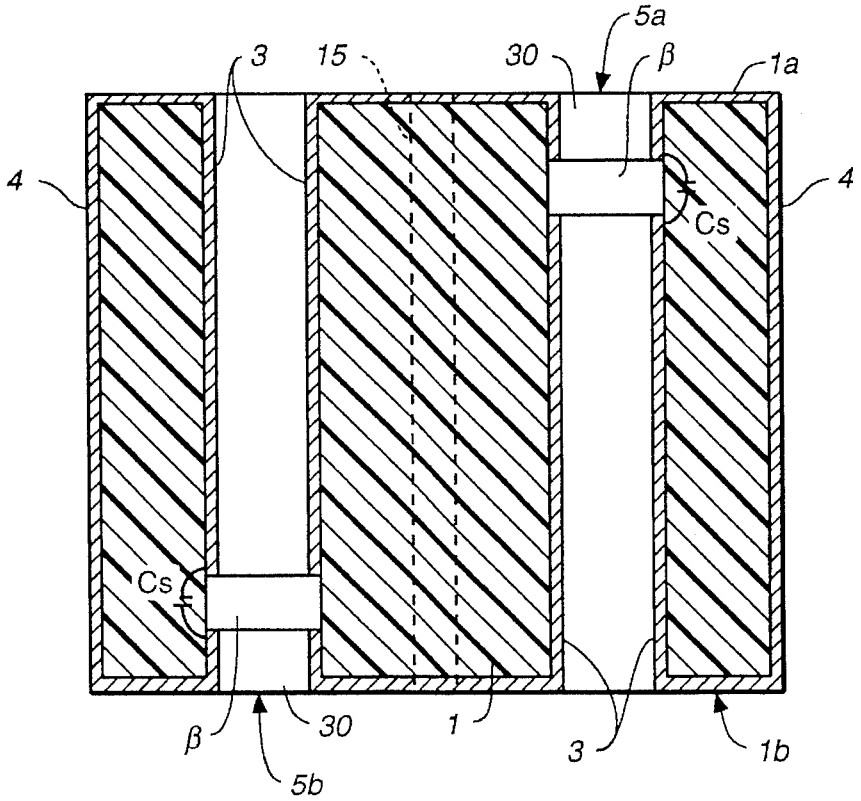
FIG. 13B is its sectional view taken along the line 13B—13B in FIG. 13A.

The tenth embodiment described above is an example of a comb-line resonator apparatus, but the present invention can be applied to interdigital resonator apparatus as shown in FIGS. 13A and 13B representing an eleventh embodiment of the invention characterized as having an additional throughhole 15 serving as coupling adjusting means between the throughholes 5*a* and 5*b* through the dielectric block 1. Inside one of the throughholes 5*a* is an uncovered part β near but recessed from one of the end surfaces 1*a* not covered by the inner conductor 3. Inside the other of the throughholes 5*b* is similarly an uncovered part β near but recessed from the other of the end surfaces 1*b* not covered by the inner conductor 3. In other aspects, the eleventh embodiment is the same as the tenth embodiment shown in FIGS. 11A, 11B and 11C, and corresponding parts are indicated by the same numerals.

Figure 14:
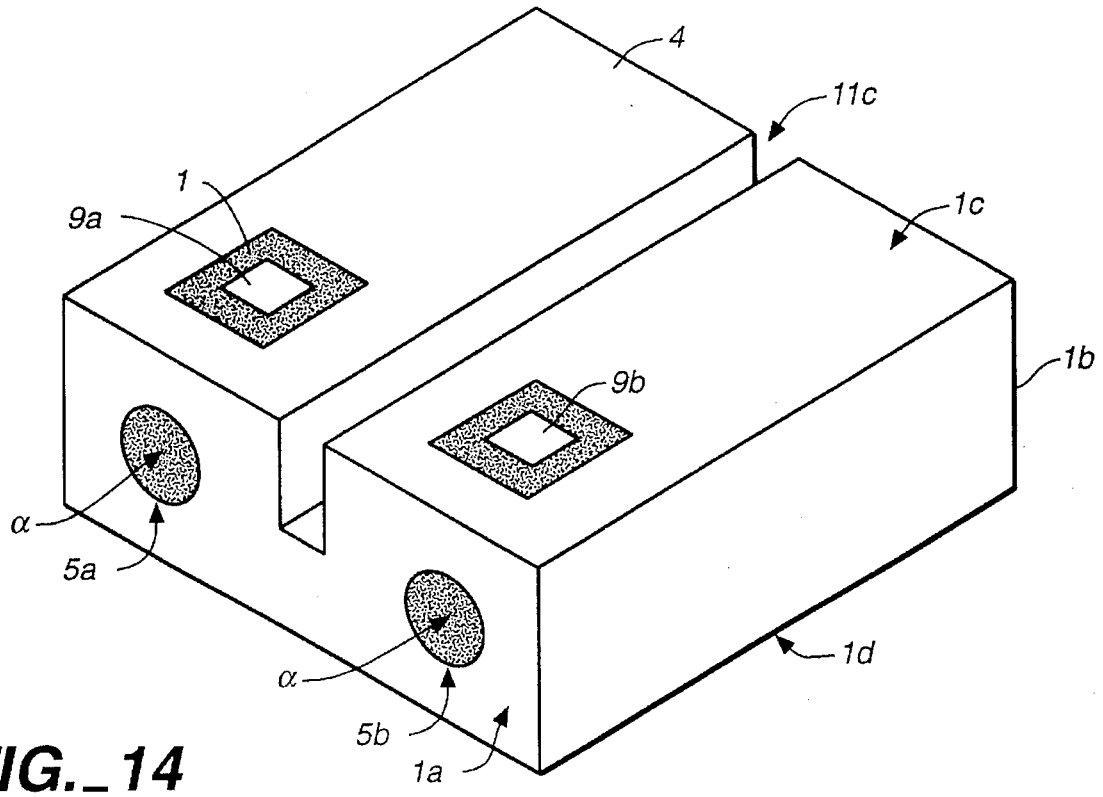
FIG. 14 is a diagonal perspective view of a dielectric resonator apparatus according to a twelfth embodiment of the invention.
Figure 20:
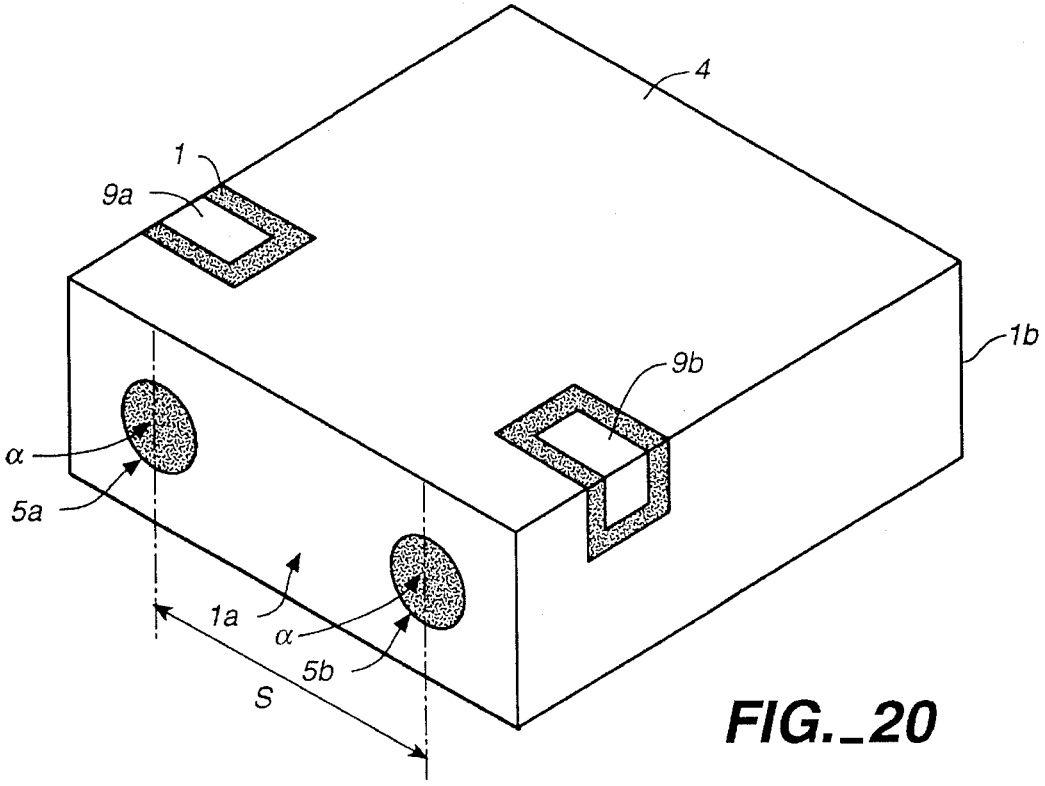
FIG. 20 is a diagonal perspective view of the dielectric resonator apparatus of FIG. 19 after its completion.

FIG. 14 shows a dielectric resonator apparatus according to a twelfth embodiment of the invention which is similar to the earlier considered apparatus shown in FIGS. 20 and 21 in that an uncovered part α is formed in each of the throughholes 5*a* and 5*b* at its opening to one of the end surfaces 1*a*. The signal input or output electrodes 9*a* and 9*b* are formed entirely on one of the main surfaces 1*c* of the dielectric block 1, and a groove 11*c* is formed between and parallel to the throughholes 5*a* and 5*b* on this main surface 1*c* along its entire length between the open and short-circuited end surfaces 1*a* and 1*b* to serve as coupling adjusting means. The inner surface of this groove 11*c* is covered by the outer conductor 4. In other aspects, the twelfth embodiment is the same as the earlier considered apparatus shown in FIGS. 20 and 21.

Because of the groove 11*c* between the throughholes 5*a* and 5*b* according to the twelfth embodiment of the invention, the coupling between the dielectric coaxial resonators can be weakened and, as a result, a dielectric resonator apparatus with a wide pass band can be obtained. Since the degree of coupling varies according to the length, width, position, cross-sectional shape, etc., it is possible to adjust the band pass characteristics without changing the external dimensions of the dielectric block 1. In other words, dielectric blocks can be standardized and made compact.

Figure 15:
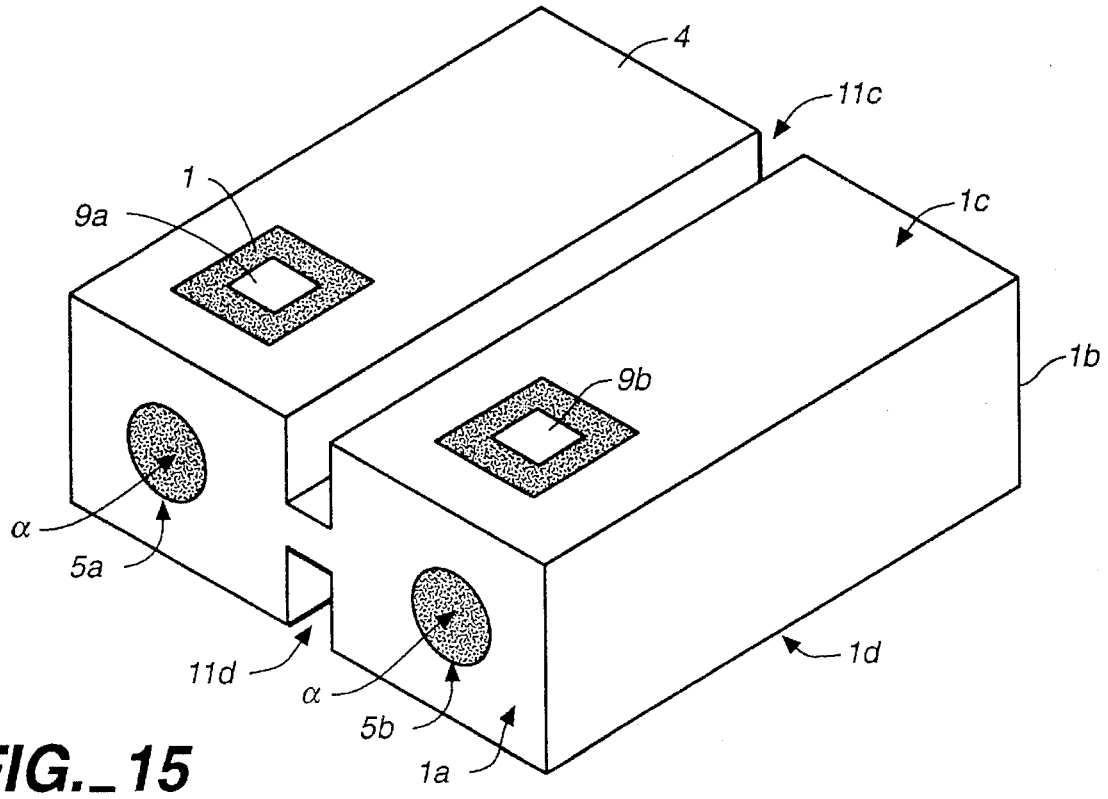
FIG. 15 is a diagonal perspective view of a dielectric resonator apparatus according to a thirteenth embodiment of the invention.
Figure 16:
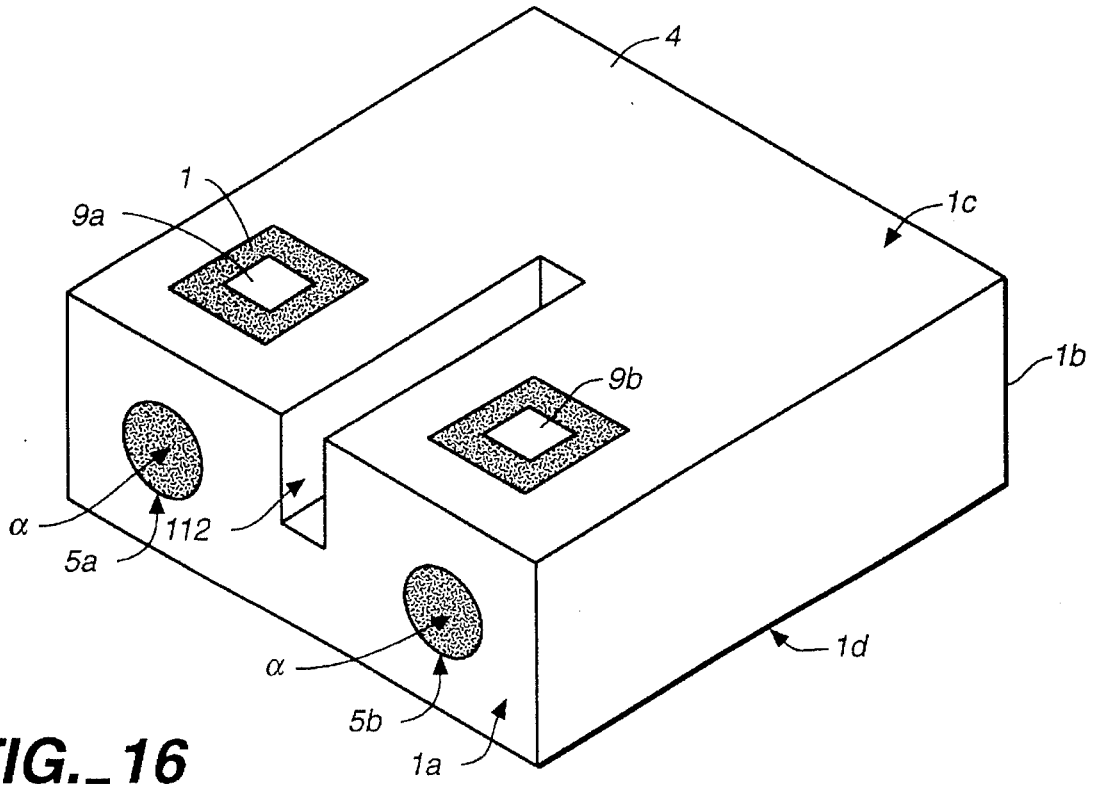
FIG. 16 is a diagonal perspective view of a dielectric resonator apparatus according to a fourteenth embodiment of the invention.
Figure 17:
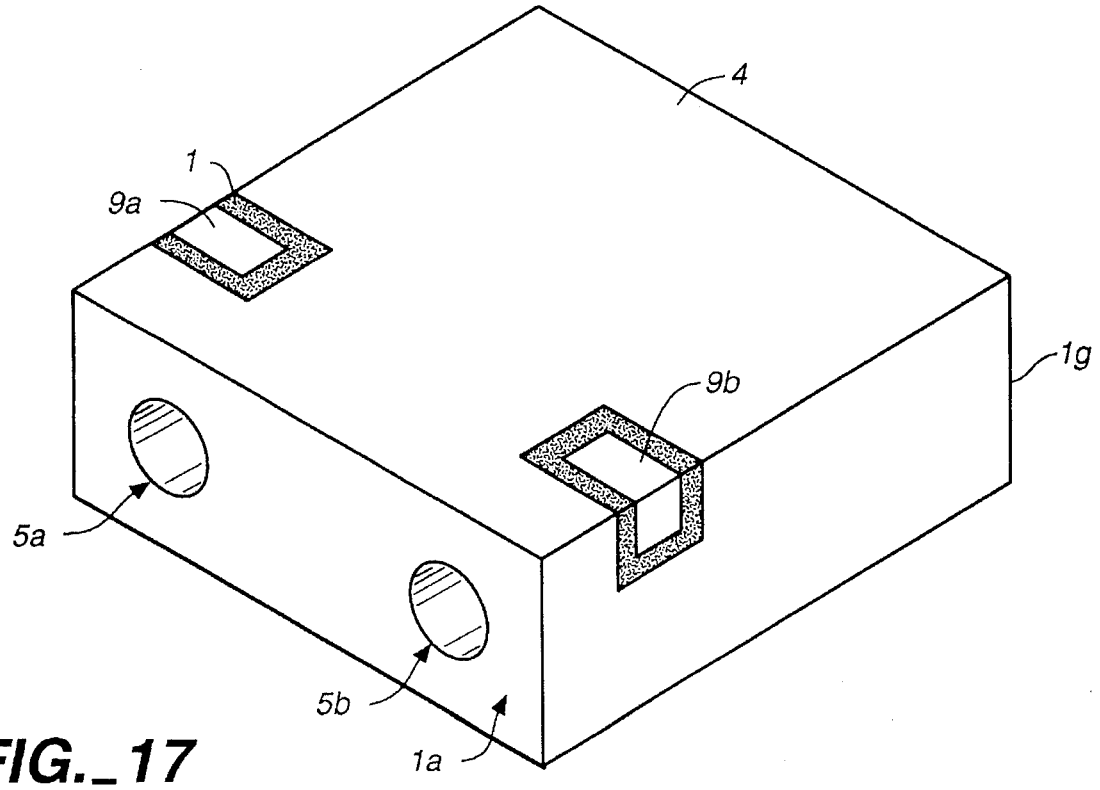
FIG. 17 is a diagonal perspective view of an earlier considered dielectric resonator apparatus before its production is completed.
Figure 18:
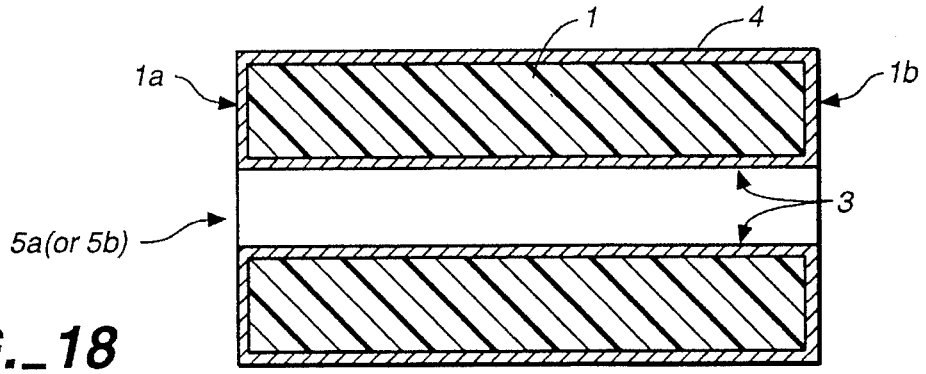
FIG. 18 is a sectional view of the dielectric resonator apparatus of FIG. 17 before its production is completed.

Although FIG. 14 shows only one groove formed on only one of the main surfaces of the dielectric block 1, two grooves 11*c* and 11*d* may be formed, as shown in FIG. 15, one on each of the two main surfaces 1*c* and 1*d* of the dielectric block 1. Moreover, the groove to be formed as coupling adjusting means need not be of the same length as the throughholes 5*a* and 5*b*. FIG. 16 shows another variation of the embodiment shown in FIG. 14, with a groove 112 with about one-half length of the throughholes 5*a* and 5*b*.

Regarding all of the embodiments described above with reference to FIGS. 1–16, the degree of coupling may be adjusted by partially removing a part of the surface or inner conductive film and/or dielectric from any of the grooves 11*a*–11*d*, 110*a*, 110*b* and 112, the bottomed hole 12 and 120, the slits 13 and 130, and throughholes 15 and 15*a*–15*g*. Since such adjustment can be effected after the assembly process has been completed, the yield of the products can be significantly improved.

In summary, the present invention makes it possible to adjust the degree of coupling between dielectric coaxial resonators through adjusting means provided to the dielectric block such that the characteristics can be adjusted without changing the external dimensions of the dielectric block. As a result, dielectric blocks can be standardized and made compact, and the cost of the final product is reduced accordingly. Additionally, asymmetry of the attenuation characteristics can be corrected, and the characteristics can be improved according to the present invention.

Although the invention was described above with reference to a limited number of examples with reference to drawings and although most of the illustrations showed only two throughholes per resonator apparatus forming coaxial resonators, this is not intended to limit the scope of the invention. Dielectric resonator apparatus according to the present invention may include a larger plural number of throughholes 5*a*, 5*b*, 5*c*, . . . formed parallel to one another through a dielectric block with their internal surfaces covered with inner conductor (with an uncover part left thereon). Such dielectric resonator apparatus with a larger number of coaxial resonators unistructurally formed are not separately illustrated. It is then to be understood that the drawings herein shown with only two throughholes 5*a* and 5*b* illustrate only a portion of the entire dielectric resonator apparatus according to the present invention including only a mutually adjacent pair of coaxial resonators.

The description provided above is intended to be interpreted broadly as being merely illustrative. Any modifications and variations thereof which may be obvious to a person skilled in relevant arts are intended to be included within the scope of the invention.

What is claimed is:

1. A dielectric resonator apparatus comprising:

a dielectric block with outer surfaces inclusive of mutually opposite main surfaces and mutually opposite end surfaces, said dielectric block having a plurality of throughholes therethrough connecting said end surfaces, each of said throughholes being linear and being cross-sectionally uniform between said end surfaces;

an outer conductor substantially entirely covering said outer surfaces of said dielectric block inclusive of said end surfaces;

input/output electrodes on said dielectric block insulated from said outer conductor;

inner conductors covering inner surfaces of each of said throughholes exclusive of specifically provided uncovered parts of said inner surfaces, thereby providing coaxial resonators, said uncovered parts being recessed from both said end surfaces, wherein said inner conductors each have one end which is electrically not in contact with said outer conductor; and adjusting means between mutually adjacent pairs of said throughholes for adjusting the degree of coupling between said coaxial resonators.

2. The dielectric resonator apparatus of claim 1 wherein said adjusting means comprises a groove on one of said main surfaces of said dielectric block, said groove having an inner surface being covered by said outer conductor.

3. The dielectric resonator apparatus of claim 2 wherein said throughholes are mutually parallel and said groove is parallel to said throughholes.

4. The dielectric resonator apparatus of claim 3 wherein said groove extends between one of said end surfaces and a position half-way between said end surfaces.

5. The dielectric resonator apparatus of claim 1 wherein said adjusting means comprises a bottomed hole extending through said dielectric block, said bottomed hole having an inner surface being covered with a conductive film connected to said outer conductor.

6. The dielectric resonator apparatus of claim 5 wherein said throughholes are mutually parallel and said bottomed hole is parallel to said throughholes.

7. The dielectric resonator apparatus of claim 6 wherein said bottomed hole opens in one of said end surfaces and extends therefrom to a position half-way between said end surfaces.

8. The dielectric resonator apparatus of claim 1 wherein said adjusting means comprises a conductive plate insert located in the dielectric block extending from one of said end surfaces and extending between said main surfaces, said conductive plate being electrically connected to said outer conductor.

9. The dielectric resonator apparatus of claim 8 wherein said throughholes are mutually parallel and said conductive plate insert extends parallel to said throughholes.

10. The dielectric resonator apparatus of claim 9 wherein said conductive plate insert extends between said one end surface and a position half-way between said end surfaces.

11. The dielectric resonator apparatus of claim 1 wherein said adjusting means comprises a slit on one of said end surfaces of said dielectric block and extending between said main surfaces, said slit having an inner surface being covered by said outer conductor.

12. The dielectric resonator apparatus of claim 11 wherein said throughholes are mutually parallel and said slit is parallel to said throughholes.

13. The dielectric resonator apparatus of claim 12 wherein said slit extends between said one end surface and a position half-way between said end surfaces.

14. A dielectric resonator apparatus comprising:

a dielectric block with mutually opposite main surfaces and mutually opposite end surfaces, a plurality of throughholes therethrough connecting said end surfaces, each of said throughholes having a step between a cross-sectionally larger part and a cross-sectionally smaller part;

an outer conductor substantially entirely covering outer surfaces of said dielectric block inclusive of said end surfaces;

input/output electrodes on said dielectric block insulated from said outer conductor;

inner conductors covering inner surfaces of said throughholes exclusive of uncovered parts each provided in said cross-sectionally larger part of one of said throughholes, thereby providing coaxial resonators, wherein said inner conductors each have one end which is electrically not in contact with said outer conductor; and adjusting means between mutually adjacent pairs of said throughholes for adjusting the degree of coupling between said coaxial resonators.

15. The dielectric resonator apparatus of claim 14 wherein said adjusting means comprises a bottomed hole through said dielectric block, the inner surface of said bottomed hole being covered with a conductive film connected to said outer conductor.

* * * * *